US007840306B2

(12) United States Patent
Di Domenico

(10) Patent No.: US 7,840,306 B2
(45) Date of Patent: Nov. 23, 2010

(54) MOLDING-SYSTEM SET-UP BASED ON MOLDED-PART ATTRIBUTE

(75) Inventor: Adamo Di Domenico, Brampton (CA)

(73) Assignee: Husky Injection Molding Systems Ltd., Bolton, Ontario (CA)

( * ) Notice: Subject to any disclaimer, the term of this patent is extended or adjusted under 35 U.S.C. 154(b) by 658 days.

(21) Appl. No.: 11/843,725

(22) Filed: Aug. 23, 2007

(65) Prior Publication Data

US 2009/0053546 A1 Feb. 26, 2009

(51) Int. Cl.
*B29C 39/00* (2006.01)

(52) U.S. Cl. ..... 700/197; 700/204; 700/281

(58) Field of Classification Search ..... 700/197, 700/200–205
See application file for complete search history.

(56) References Cited

U.S. PATENT DOCUMENTS

| | | | | |
|---|---|---|---|---|
| 3,767,339 | A | 10/1973 | Hunkar | |
| 3,860,801 | A | 1/1975 | Hunkar | |
| 3,889,849 | A | 6/1975 | Chandler | |
| 3,941,534 | A | 3/1976 | Hunkar | |
| 4,311,446 | A | 1/1982 | Hold et al. | |
| 5,035,598 | A | 7/1991 | Fujita et al. | |
| 5,040,589 | A | 8/1991 | Bradley et al. | |
| 5,062,784 | A | 11/1991 | Inaba et al. | |
| 5,470,218 | A | 11/1995 | Hillman et al. | |
| 5,500,166 | A | 3/1996 | Sasaki et al. | |
| 5,518,671 | A | 5/1996 | Tazikawa et al. | |
| 5,539,650 | A | 7/1996 | Hehl | |
| 5,550,744 | A | 8/1996 | Steinbichler | |
| 5,898,591 | A | 4/1999 | Hettinga et al. | |
| 5,900,259 | A | 5/1999 | Miyoshi et al. | |
| 7,037,452 | B1 | 5/2006 | Speight | |
| 2001/0051858 | A1 | 12/2001 | Liang et al. | |
| 2004/0093115 | A1 | 5/2004 | Usui et al. | |
| 2006/0012064 | A1 * | 1/2006 | Hutson et al. | 264/40.1 |
| 2006/0235568 | A1 * | 10/2006 | Araki et al. | 700/200 |

OTHER PUBLICATIONS

International Search Report 6 pages.
Matthew H. Naitove, "Artificial Intelligence Already Taking many Forms in Plastics Processing", Plastics Technology, Mar. 1, 1991.
Jack K. Rogers, "Intelligent Molding: Expert Systems Are Coming On Line Now", Modern Plastics International, May 1992, pp. 44 to 47.
Joseph A. Sneller, "Controls That Think Bring Improved Accuracy to Injection Molding", Modern Plastics, Dec. 1985, pp. 42 to 44.
R. Nunn and C. Grolman, "Adaptive Process Control for Injection Molding", Antec 88, pp. 298 to 304.
"Sophisticated New Computer Systems Analyze Injection Molding", Plastics Technology, Nov. 1985, pp. 29 and 31.

* cited by examiner

*Primary Examiner*—Paul L Rodriguez
*Assistant Examiner*—Nathan Laughlin
(74) *Attorney, Agent, or Firm*—Husky Intellectual Property Services

(57) ABSTRACT

A molding-system set-up process has: (i) a receiving operation, including receiving an attribute associated with a molded part, (ii) a determining operation, including determining a molding-system set-up parameter based on the attribute associated with the receiving operation, the molding-system set-up parameter being usable for setting up a molding-system operation, and (iii) a providing operation, including providing the molding-system set-up parameter.

5 Claims, 16 Drawing Sheets

| 600 | | | | | | | | | | | | | | | | |
|---|---|---|---|---|---|---|---|---|---|---|---|---|---|---|---|---|
| 602 | 604 | | | | | | | | | 606 | | | | 608 | | |
| | A1 | A2 | A3 | A4 | A5 | A6 | A7 | A8 | A9 | B1 | B2 | B3 | B4 | C1 | C2 | C3 |
| P1 | | | | | | | | | | | | | | | | |
| P2 | | | | | | | | | | | | | | | | |
| P3 | 1135 (°F) | 1135 (°F) | 1135 (°F) | 950 (°F) | 1135 (°F) | 1135 (°F) | 1135 (°F) | 1135 (°F) | 1135 (°F) | 1135 (°F) | 1125 (°F) | 1120 (°F) | 1115 (°F) | 1100 (°F) | 1065 (°F) | 1050 (°F) |
| P4 | | | | | | | | | | | | | | | | |
| P5 | | | | | | | | | | | | | | | | |

FIG. 7B

MOLDING-SYSTEM SET-UP BASED ON MOLDED-PART ATTRIBUTE

TECHNICAL FIELD

The present invention generally relates to, but is not limited to, molding systems, and more specifically the present invention relates to, but is not limited to, molding-system set-up parameter for a molding system.

BACKGROUND

Examples of known molding systems are (amongst others): (i) the HyPET (trademark) Molding System, (ii) the Quadloc (Trademark) Molding System, (iii) the Hylectric (trademark) Molding System, and (iv) the HyMET (trademark) Molding System, all manufactured by Husky Injection Molding Systems (Location: Canada; www.husky.ca).

U.S. Pat. No. 3,767,339 (Inventor: HUNKAR; Published: 1973-10) discloses an injection molding control that provides for programmable control of ram velocity as a function of the position of the ram through closed-loop feedback of the measured actual velocity. Closed-loop feedback of the actual mold cavity pressure overrides the velocity program in an analog fashion to stop the ram when critical cavity pressure has been attained. A variable length ram stroke provides optimization of the shot size through automatic variation in response to the closed-loop feedback of ram position at the instant of the attaining of critical pressure in the previous injection cycle. The shot size control is used to maintain a constant cushion in each cycle as measured at the instant critical pressure is reached to insure constant product density and uniformity of shrinkage. Automatic recompensation of the velocity program domain with respect to ram position relates the material injection rate more directly to the actual quantity material being injected. Adaptation to factors such as material density and viscosity changes is realized.

U.S. Pat. No. 3,860,801 (Inventor: HUNKAR; Published: 1975-01) discloses an injection molding control to promote uniformity in the mass of the injection charge from cycle to cycle. An injection ram is reciprocated between a fixed forward, or cushion, point coincident with the end of charge injection, and an adjustable rearward, or retraction, point correlated to size of the next charge. The retraction point is corrected at the conclusion of each injection cycle in response to comparing a reference pressure, which is correlated to the mold cavity pressure existing at the conclusion of injecting a charge of the desired mass into the molding cavity, with the pressure of the plasticized material upstream of the orifice through which the material is injected into the mold cavity. The material pressure upstream of the orifice is sampled for comparison against the reference pressure at a point in time following injection when the ram has a predetermined velocity, preferably when it has come to rest, and the injected material in the region of the orifice has not yet solidified, whereby the sampled melt pressure is correlated to the cavity pressure at the conclusion of injection and hence to the mass of the injection charge. Depending upon whether the sampled melt pressure upstream of the orifice is above or below the reference pressure, the retraction point is shifted closer to, or further from, the orifice, respectively, to shorten or extend, respectively, the distance over which plasticized material for the next charge is accumulated forward of the ram tip.

U.S. Pat. No. 3,889,849 (Inventor: CHANDLER; Published: 1975-06) discloses a simplified process computer for effecting the continued operation of an injection molding machine in a predetermined mode. A timer is started when the injection ram begins an injection stroke. When a first predetermined time has elapsed, it is assumed that the initial cushion point has been reached and the ram injection pressure is reduced to a holding value. At a subsequent time a comparison is made between a signal representing an actual final ram cushion point position, and another signal representing the desired position. An error signal is then generated and utilized to change the screw-back and pull-back positions of the ram. Simultaneous modification of the screw-back and pull-back points maintains a constant shot volume for each injection stroke. In another embodiment the transition from injection to holding pressure is accomplished as a function of ram position rather than time. The error signal is then also utilized to control the point at which the pressure change occurs.

U.S. Pat. No. 3,941,534 (Inventor: HUNKAR; Published: 1976-03) discloses an injection molding control that provides for programmable control of ram velocity as a function of the position of the ram through closed-loop feed-back of the measured actual velocity. Closed-loop feed-back of the actual mold cavity pressure overrides the velocity program in an analog fashion to stop the ram when a preset cavity pressure has been attained associated with a desired charge size. Programmable control of the ram screw speed and/or back pressure during injection as a function of ram position or time is used to impart a predetermined temperature profile to the charge along the length thereof while it is in the barrel prior to injection. This enables controlled variation in density of the molded article throughout its volume to achieve desired levels in pre-selected characteristics such as surface wear, gloss, resolution and the like. A closed-loop servo system responsive to hydraulic pressure on the ram, including a flow divider valve which meters flow between the ram pressure chamber and a drain tank, provides accurate and continuous control of injection, hold and back pressure to enhance product quality; smooth pressure transitions between different ram pressure levels utilized in the molding cycle to avoid undesirable effects due to ram overshoot; simultaneous flow and pressure increase during injection when ram velocity falls below programmed level thereby avoiding sluggish response characteristics when restoring ram velocity; and reduction in number of hydraulic components required to effect the injection, hold, and back pressure functions.

U.S. Pat. No. 4,311,446 (Inventor: HOLD et al.; Published: 1982-01) discloses a method and an apparatus for controlling the parameters of injection molding processes in a machine having a barrel with a plasticating chamber and a screw, rotatably and slidably disposed in said chamber, hopper means adjacent one end of said chamber communicating therewith and nozzle means disposed in the other end of said chamber communicating with a mold. Control of the injection molding process is achieved through an event recognition philosophy by sensing screw position, screw injection velocity, melt temperature, comparing the values at certain instances during the work cycle with known or desired values and using these values, changes of values and differences of values to monitor and initiate changes in the process parameters.

U.S. Pat. No. 5,062,784 (Inventor: INABA et al.; Published: 1991-11) discloses a molding condition recording apparatus having a manual data input device with a CRT. The manual data input device has various keys for inputting parameters of various groups used for controlling injection, hold, metering and cylinder temperature, and for inputting molding defect indication data. A microprocessor for a programmable machine computer causes the input parameters and the molding defect indication data to be stored in a molding condition storage region of a shared memory. The microprocessor then discriminates similarity between the thus stored molding condition and the molding condition already registered in a molding condition/molding defect storage file of a memory other than the shared memory. If there is similarity between these molding conditions, the microprocessor causes the CRT to display an alarm message thereon together with the parameter already registered in the file and the mold defect indication data. When there is no similarity between the molding conditions, the microprocessor transfers the molding condition stored in the shared memory to the file for storage therein. Even when the alarm message is displayed, a similar transfer and storage process is carried out if it is requested by an operator.

U.S. Pat. No. 5,035,598 (Inventor: FUJITA et al; Published: Jul. 30, 1991) discloses an optimum molding condition setting system for an injection molding machine comprises a molten material flow analysis component for analyzing resin flow, resin cooling and the structure/strength of molded products by using a designed mold model and also comprises an analysis result evaluation component for determining an initial molding condition and its permissible range in accordance with the analysis results. The initial molding condition is set into the injection molding machine and a test shot is carried out in order to check for a deficiency of a molded product. If a deficiency of the molded product is detected, a data of the deficiency is entered into a molding defect elimination component. After performing a convenient data processing based on the entered data, a cause of the molding defect can be inferred and a measure for the cause can be obtained with high efficiency and accuracy. Consequently, the molding condition can properly and immediately be corrected in accordance with data obtained by the molten material flow analysis component.

U.S. Pat. No. 5,470,218 (Inventor: HILLMAN et al.; Published: 1995-11) discloses an injection blow molding apparatus. The apparatus includes an injection blow molding machine having work stations and molds. The apparatus includes a process computer for operating the blow molding machine according to a set of processing parameters. Each processing parameter has a respective desired operating range. The apparatus includes a touch screen for inputting signals to the processor for commanding the process computer to adjust the processing parameters. Display software and hardware coupled to the process computer and the touch screen cause the monitor to display respective icons representing each processing parameter. The value of each respective processing parameter is displayed adjacent to the icon. Graphing software generates signals which are transmitted to the monitor. The monitor displays a graph of the selected processing parameter value as a function of time. The graph is plotted in response to an operator touching a portion of the touch screen beneath which the selected icon is displayed. Alarm software causes the monitor to display an alarm message. The alarm message identifies whether any one of the processing parameters is operating outside its desired operating range.

U.S. Pat. No. 5,500,166 (Inventor: SASAKI et al.; Published: 1996-03) discloses an injection and compression molding process where molten material is fed by a screw, incorporating a counter-flow preventing valve (CPV), through a flow control valve (FCV) into a mold cavity. The injection volume is controlled by/with the FCV closed. The process includes: (I) feeding a predetermined quantity of material through the CPV into a chamber between the CPV and the FCV, then (II) advancing the screw with the FCV maintained closed to cause the CPV to close, thereby raising the pressure of the material in the chamber, determining when the pressure of the material in the chamber reaches a predetermined pressure, (III) determining whether the movable die is at a predetermined distance from the stationary die, (IV) opening the FCV after the pressure of the material in the chamber has reached said predetermined pressure and the movable die is at the predetermined distance from the stationary die, (V) setting as an original point of a determination of the injection volume either (a) a position of the screw at the opening of the FCV or (b) a time at the opening of the FCV, (VI) injecting the material into the mold cavity while the mold cavity is open to atmospheric pressure, closing the FCV either (a) when the screw has reached a position advanced a predetermined distance from the thus set original point or (b) at a predetermined time after the thus set original point, and compressing the material in the mold cavity.

U.S. Pat. No. 5,518,671 (Inventor: TAKIZAWA et al.; Published: 1996-05) discloses a method of setting molding conditions for an injection molding machine 1 using a mold 2 whose specifications data are unclear included three setting processes. In the first setting process A, by inputting known data into computer 3, the molding conditions based on a data base prepared in advance and said input known data are set. In the second setting process B, injection molding is performed according to prescribed molding conditions pre-selected concerning injection pressure P, injection speed V and the injection start position of screw 4, and then, based on the product just molded, injection pressure P is altered, to set said altered injection pressure P, injection speed V and proper pre-feed measurement value Md as molding conditions. In the third setting process C, injection molding is performed according to molding conditions obtained from said second setting process B, and subsequently, taking into account the findings from the product just molded, said molding conditions are adjusted. In this manner, even an unskilled operator is allowed to undertake setting molding conditions reliably and with great ease for an injection molding machine loaded with a set of molds whose specifications data are unclear.

U.S. Pat. No. 5,539,650 (Inventor: HEHL; Published; Jul. 23, 1996) discloses computer based interactive control of a plastics injection molding machine during input of portions of a production sequence and configuration of an injection cycle, which is effected essentially before the onset of the injection molding process. For a mold guided by an operator, operating parameters required for a process sequence are input by way of an input unit into a computer based control unit storing these operating parameters. Subsequently, one or a plurality of injection cycles is implemented according to the stored operating parameters. A physically possible production sequence, as well as a production sequence that is structurally specific to the machine and the tool employed, including any peripheral devices provided at the respective machine or associated therewith, are determined with the control unit. An operator is provided with a selection of possible inputs of further portions of the production sequence that can be added to the existing portions and are compatible with the machine and the tool based on the determination.

U.S. Pat. No. 5,550,744 (inventor: STEINBICHLER; Published: Aug. 27, 1996) discloses a process for controlling a production machine, in particular an injection molded machine that produces injection molded plastic parts. During a learning cycle, rating fields that indicate the relationship between selected quality parameters of the products and selected setting parameters of the machine are determined and stored. To allow the machine to be controlled by entering the actual target values, i.e. the quality parameters of the products, the set values or set value ranges for at least two selected quality parameters are entered into a control device.

The control device then determines at least one set of selected setting parameters on the basis of the stored rating fields, all predetermined quality parameters simultaneously corresponding to the predetermined set values or lying in the predetermine set value ranges.

U.S. Pat. No. 5,898,591 (Inventor: HETTINGA et al.; Published: 1999-04) discloses an article of manufacture is provided where the article of manufacture comprises a computer usable medium having computer readable program code means therein. The computer readable program code means causes a computer to receive information, establish a molding profile based on the information, operate a molding machine to mold an article according to the molding profile, receive additional information corresponding to detected irregularities on the molded article, establish a modified molding profile based on the additional information received, and operate the molding machine to mold an additional article according to the modified molding profile. The additional information received by the computer which corresponds to detected irregularities on the molded article may be provided by a human operator, by a second computer, or by any other means.

U.S. Pat. No. 5,900,259 (Inventor: MIYOSHI et al.; Published: 1999-05) discloses a molding condition optimizing system for an injection molding machine comprising plastic flow condition optimizing section and an operating condition determining section is disclosed. The plastic flow condition optimizing section carries out a plastic flow analysis on a molded part model, and determines an optimum flow condition in a filling stage and a packing stage of an injection molding process of the injection molding machine by repeatedly executing an automated calculation using the result of the plastic flow analysis and the plastic flow analysis itself. The operating condition determining section comprises an injection-side condition determining section for determining an optimum injection-side condition of the injection molding machine according to the optimum flow condition obtained by the plastic flow condition optimizing means and a knowledge database with respect to an injection condition, and a clamping-side condition determining section for determining an optimum clamping-side condition according to the molded part form data generated by the plastic flow condition optimizing means, the result of the plastic flow analysis, mold design data, and a knowledge database with respect to a mold clamping condition.

U.S. Pat. No. 7,037,452 (Inventor: SPEIGHT; Published: May 2, 2006) discloses a method for the automated optimization of an injection molding machine set-up process comprising injection molding one or more parts, inspecting the parts for defects, adjusting the injection stroke and/or the injection velocity and repeating the process until the defects are reduced. There is also disclosed a method comprising injection molding one or more parts, determining a mean injection pressure profile by measuring the injection pressure with the machine configured with a constant, desired injection velocity. Then the velocity profile is adjusted to reduce differences between the measured pressure and the mean pressure profile. A further method is disclosed wherein the kickback is calculated and adjusted from screw displacement, packing/holding time and pressure. Also disclosed is a method comprising injection molding one or more parts then determining the gate freeze time by incrementing the holding time and measuring the screw displacement.

United States Patent Application Number 2001/0051858 (Inventor: LIANG et al; Published: Dec. 13, 2001) discloses a combination of an experimental design method with a moldflow analysis software to simulate the real injection molding processes of the injection molding machine, analyze the simulation results, and develop a database for the quantitative relationship between the parameters of the injection molding machine and the parameters of the injection molding product quality. The database is then used to develop a neural network which can predict the qualities of the injection molding products. The operators of the injection molding machine can input the undetermined parameters to the developed neural network; after execution, the neural network outputs the predicted parameters of the injection molding product quality. The present invention can help the operators to set the parameters, cut down the time on finding appropriate molding parameters, reduce the time of futile try-and-error, and enhance quality by reducing defects.

United States Patent Application Number 2004/093115 (Inventor: USUI et al; Published: May, 13, 2004) discloses the following: when a determination condition is set for determining whether a molded product is non-defective or defective, a molding operation is performed a predetermined number of times. In each molding operation, an actual value of at least one monitor item which can serve as the basis for determining whether a molded product is non-defective or defective is detected. The detected actual values are displayed on a screen of a display in such a manner that a distribution of the actual values can be visually grasped. A sampling zone for the displayed actual values is designated in such a manner that a portion of the displayed actual values are contained in the sampling zone. The determination condition is automatically set on the basis of actual values contained in the sampling zone.

Non-patent publication titled: "Artificial Intelligence Already Taking Many Forms in Plastics Processing" authored by Matthew H. NAITOVE (this article is believed to be published in a trade journal called "Plastics Technology") discloses software smart machines and smart factories are coming to plastics processing.

Non-patent publication titled: "Intelligent Molding: Expert Systems Are Coming On Line Now" authored by Jack K. ROGERS (this article is believed to be published in a trade journal called "Modern Plastics International" in May 1992 from pages 44 to 47) discloses that processing engineers are applying expert system technology to injection molding, replacing the "black art" of experienced machine operators who instinctively knows which knob to tweak with a computer program.

Non-patent publication titled: "Controls That Think bring Improved Accuracy to Injection Molding" authored by Joseph A. SNELLER (this article is believed to be published in a trade journal called "Modern Plastics" in December 1985 from pages 42 to 44) discloses that every one is foolproof molding. Now process controls that analyze what's happening in the machine and apply human-like reasoning to the problem could make bad-part rejects a thing of the past.

Non-patent publication titled: "Adaptive Process Control for Injection Molding" authored by R. NUNN and C. GROLMAN (this article is believed to be published in a trade journal called "ANTEC '88" from pages 298 to 304) discloses that in practice, the molder knows that the successful application of the process is critically dependent on a very elusive complex of interrelated dimensions; mass, time, pressure, and temperature.

Non-patent publication titled: "Sophisticated New Computer Systems Analyze Injection Molding" and the author is unknown (this article is believed to be published in a trade journal called "Plastics Technology" in November 1985 from pages 29 and 31) discloses that computers have been developed for plastics injection molding process analysis, such as:

(i) searching for an optimum processing conditions for a given resin or compound, and (ii) implying troubleshooting of molding problems.

SUMMARY

The inventor believes that persons of skill in the art are not aware of the problem as understood by the inventor. The known molding systems of today include manually-operated functions where technicians (operators) input desired system molding-system set-up parameter (parameters) that are stored in a memory of a computer to allow the computer to operate the molding system within certain operational limits. Prior to the aspects of the present invention described herein, the set up and operation of known molding systems are highly dependent upon the expertise and knowledge associated with the operators of the known molding systems. It is desired to make molded parts or articles that meet the requirements associated with quality, geometric size, physical and mechanical properties; to meet this objective in the past, the operator of the known molding system would have to manually tune the molding system based on the knowledge and experience of the operator. Disadvantageously, if the operator were no longer available, operation of the known molding systems becomes a difficult and onerous task, especially for setting up and configuring a molding system for making new molded articles.

The inventor believes the problem is mitigated, at least in part by the following aspects of the present invention:

According to a first aspect of the present invention, there is provided a molding-system process, including: (i) a receiving operation, including receiving an attribute associated with a molded part, (ii) a determining operation, including determining a molding-system set-up parameter based on the attribute associated with the receiving operation, the molding-system set-up parameter being usable for setting up a molding-system operation, and (iii) a providing operation, including providing the molding-system set-up parameter, the providing operation reducing time associated with trial and error set up of molding systems.

Technical effect, amongst other technical effects, are (i) reduced time associated with setting up a molding system, (ii) determine compatibility between molding system and mold in view of required processing factors (such as: number of parts to make per day, etc) before using the mold with a molding system, (iii) reduce time associated with operator's manual 'trial and error' approach to processing set up of the molding system, (iv) obtain processing requirements in an efficient manner without having to resort to highly-experienced staff, and/or (v) improved product value for customer (end user of molding system)

DESCRIPTION OF THE DRAWINGS

A better understanding of the non-limiting embodiments of the present invention (including alternatives and/or variations thereof) may be obtained with reference to the detailed description of the non-limiting embodiments of the present invention along with the following drawings, in which:

FIG. 7B depicts a determining operation 304 associated with the process 298 of FIG. 1 according to a sixth non-limiting embodiment;

The drawings are not necessarily to scale and are sometimes illustrated by phantom lines, diagrammatic representations and fragmentary views. In certain instances, details that are not necessary for an understanding of the embodiments or that render other details difficult to perceive may have been omitted.

DETAILED DESCRIPTION OF THE NON-LIMITING EMBODIMENTS

Figure 1:
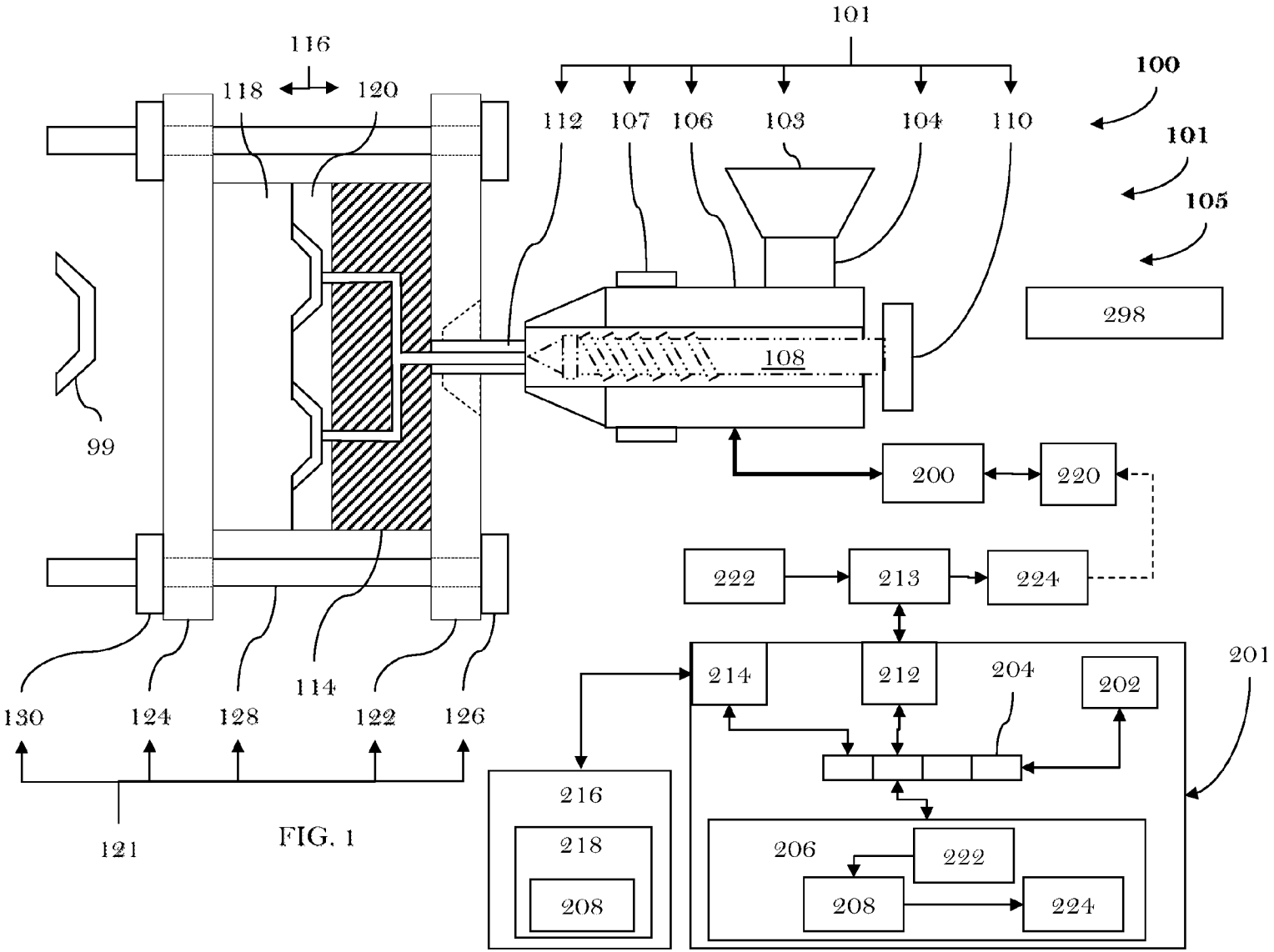
FIG. 1 depicts a schematic representation of: (i) a molding system 100 (hereafter referred to as the "system 100") that is operative in accordance with a molding-system set-up process 298 (hereafter referred to as the "process 298") according to a first non-limiting embodiment, (ii) a computer 200 (according to a second non-limiting embodiment) that is configured to control functions of the system 100 in accordance with the process 298, and (iii) a program 208 (according to a third non-limiting embodiment) that is configured to instruct the computer 200 in accordance with the process 298.

FIG. 1 depicts the schematic representation of the system 100. The system 100 may be, for example: (i) an injection molding system 101 that is configured to inject plastic-based molding material into a mold, or (ii) a metal injection molding system 105 that is configured to inject a metallic-based molding material into a mold. The system 100 is operative in accordance with the molding-system set-up process 298 (hereafter referred to as the "process 298") according to the first non-limiting embodiment. Details regarding the process 298 and variants of the process 298 are provided below in connection with FIGS. 2, 4A to 4D, 6A, 6B and 7A to 71. Also depicted is the computer 200 (according to the second non-limiting embodiment) that is configured to control the computer-controllable elements or components associated with the system 100 in accordance with the process 298.

The computer 200 or 201 includes a memory 206 that embodies a program 208 that has instructions usable for instructing the computer 200 or 201 to control the system 100 in accordance with the molding-system set-up process 298. A memory 206 for the computer 200 or 201 embodies a program 208 that has instructions usable for instructing the computer 200 or 201 to control the system 100 in accordance with the molding-system set-up process 298. An article of manufacture 216 includes the computer-usable medium 218 that embodies instructions usable for instructing the computer 200 or 201 to control the system 100 in accordance with the molding-system set-up process 298.

Also depicted is the program 208 (according to the third non-limiting embodiment) that is configured to instruct the computer 200 in accordance with the process 298, so that the system 100 may be operable in accordance with the process 298. The instructions of the program 208 are executable by the computer 200 (more specifically, the instructions are executable by the processor 202). The program 208 may be derived from a set of high-level programmed instructions (such as those instructions provided in FORTRAN or in C++, for example), and the high-level programmed instructions may be compiled and formed into the computer-executable instructions. It is believed that the description associated with the process 298, provided below, may be converted into the high-level programmed instructions by persons of skill in the art of computer programming and in the art of controls associated with molding systems, with a reasonable amount of experimentation and effort that may be expected.

The system 100 includes components that are known to persons skilled in the art, and these known components will not be described here; however, these known components are described, at least in part, in the following text books (by way of example): (i) *Injection Molding Handbook* by Osswald/Turng/Gramann (ISBN: 3-446-21669-2; publisher: Hanser), (ii) *Injection Molding Handbook* by Rosato and Rosato (ISBN: 0-412-99381-3; publisher: Chapman & Hill), and/or (iii) *Injection Molding Systems* 3rd Edition by Johannaber (ISBN 3-446-17733-7).

The system 100 includes (but is not limited to): (i) an extruder 101, and (ii) a clamp assembly 121 that is intractable with the extruder 101. In operation: the clamp assembly 121 is acutated so as to clamp a mold 116 shut by an application of force tonnage to the mold 116, while the mold 116 receives a molten molding material, under pressure, from the extruder 101. The system 100 includes components that cooperate to handle the molten molding material. According to a non-limiting variant, the molten molding material includes an alloy, or a light-metal alloy, such as a magnesium alloy, which is injected into the mold 116 to make the molded part 99, such as a laptop case or housing, a cell phone housing, automotive parts, etc. The moldable molding material may also be referred to as a feedstock.

The mold 116 is treated as a replacable or consumable or refurishable "tool", and thus the mold 116 is usually sold separately from the system 100. The extruder 101 may be: (i) a reciprocating-screw (RS) extruder, or (ii) a two-stage extruder that has a shooting pot configuration. By way of example, the extruder 101 includes (but is not limited to): (i) a hopper 103, (ii) a feed throat 104, (iii) a barrel assembly 106, a heater assembly 107, (iv) a screw 108, (v) a drive 110, and (vi) a nozzle 112. The feed throat 104 connects the hopper 103 to the barrel assembly 106, so that a moldable molding material (typically in chip form) may be transferred from the hopper 103 to the interior of the barrel assembly 106. The heater assembly 107 is coupled to the barrel assembly 106, so that heat may be transferred from the heater assembly 107 to the barrel assembly 106 and then to the molten molding material that is held in the interior of the barrel assembly 106. The heater assembly 107 includes a plurality of heaters (not depicted, such as band heaters, or coils of heating wire, etc) that are individually coupled to selected zones of the barrel assembly 106, and this manner the selected zones may be individually (or independently) heated according to processing requirements that are associated with processing the molding material. The screw 108 is operatively mounted in the interior channel of the barrel assembly 106, so that the screw 108 may be linearly translated or rotated in the interior channel of the barrel assembly 106. The screw 108 is used to process or prepare the molding material (that is, the screw 108 may be used to convey the molding material from the feed throat 104 to the machine nozzle 112). If the molding material includes a metallic alloy, the heater assembly 107 is used to convert the molding material from a solid state to a liquid state or semi-liquid (or slurry) state. Otherwise, if the molding material includes a plastic material, the screw 108 is rotated so as to frictionally engage the molding material against the interior of the barrel assembly 106 so that heat that is generated by way of this frictional engagement may be used to melt the molding material, and in this manner the heater assembly 107 is used to maintain the molding material (that is held in the barrel assembly 106) in a molten state. The drive 110 is connected with the screw 108. The drive 110 is used to translate the screw 108 and to rotate the screw 108. A non-return check valve (not depicted) may be attached to the tip of the screw 108 is so required. The nozzle 112 is connected with an exit of the barrel assembly 106 at a location that is offset from the feed throat 104.

If the mold 116 defines multiple mold cavities, as depicted in FIG. 1, then the nozzle 112 is coupled to an input of a hot runner 114, and outputs of the hot runner 114 are coupled to respective mold cavities. If the mold 116 defines a single cavity (not depicted), then the nozzle 112 is coupled to the mold 116 through an intermediate structure such as a sprue if so desired, so that the molding material may be transferred from the nozzle 112 to the cavity of the mold 116. The drive 110 is used to: (i) rotate the screw 108 so that the molten molding material may be conveyed toward the mold 116, and (ii) translate the screw 108 so as to inject the molten molding material from the barrel assembly 106 toward the mold 116 (via the nozzle 112).

The clamp assembly 121 includes: (i) a stationary platen 122, (ii) a movable platen 124, (iii) tie bars 128, (iv) lock nuts 130 , and (v) clamps 126. The stationary platen 122 is configured to support a stationary mold portion 120 of the mold 116. The movable platen 124 is configured to support a movable mold portion 118 of the mold 116. The tie bars 128 extend between respective corners of the stationary platen 122 and the movable platen 124. The lock nuts 130 are used to lock and unlock respective tie bars 128 with respective corners of the movable platen 124. The clamps 126 are: (i) mounted to respective corners of the stationary platen 122, and (ii) connected with respective tie bars 128.

In operation, a platen stroke actuator (not depicted) is actuated so as to move the movable platen 124 toward the stationary platen 122 until the mold 116 is closed so as to define a mold cavity. The lock nuts 130 lock the tie bars to the movable platen 124. The clamp assembly 121 is actuated so as to clamp the mold 116 shut, under an application of force tonnage (which is applied by the clamps 126 to the platens 122, 124). The mold 116 receives the molten molding material, under pressure, from the extruder 101 via the nozzle 112. Once a molded part 99 is made (solidified) in the mold 116: (i) the clamps 126 are decompressed, (ii) the lock nuts 130 unlock the tie bars from the movable platen 124, (iii) the mold 116 is broken apart under application of a mold-break force (by actuators that are not depicted), and (iv) the platen stroke actuator is used to move the movable platen 124 away from the stationary platen 122 so that the mold 116 may be opened, and then the molded part 99 may be removed from the mold 116; then the cycle may be repeated so as to mold another molded article. etc.

The computer 200 is configured to control computer-controllable components that are associated with the system 100. A human-machine interface 220 (hereafter referred to as the "HMI 220") is operatively connected with the computer 200. According to the first non-limiting embodiment, the process 298 is: (i) executed by a computer 201, and (ii) not executed by the computer 200 so that the results obtained from the computer 201 in association with determining aspects of the process 298 can then be used by the computer 200 (that is, the results may be transferred to the computer 200). Therefore, according to a non-limiting variant, the process 298 is executed by the computer 200 (and the computer 201 is not used). According to the first non-limiting embodiment, the computer 201 is used to provide a molding-system set-up parameter that is useful for determining a molding-system set-up parameter (or configuration) associated with the system 100. The operator of the system 100: (i) views the molding-system set-up parameter provided by the computer 201, and (ii) enters the molding-system set-up parameter into the computer 200 (via appropriate interfaces or devices). Elements of the computer 200 and of the computer 201 are common, and will be depicted with the same reference numerals.

The computer 201 includes: (i) a processor 202, (ii) a bus 204, (iii) a memory 206, and (iv) input/output (I/O) devices 212, 214. The bus 204 is coupled with: (i) the processor 202, (ii) the memory 206, and (iii) the I/O devices 212, 214. The processor 202 controls the elements of the computer 201 by sending and receiving signals via the bus 204, as understood by those skilled in the art. The I/O device 212 is coupled with the HMI 213. An attribute 222 is entered into the HMI 213, and the processor 202 transfers the attribute 222 to the memory 206 via the bus 204. Stored in the memory 206 is a program 208. The program 208 provides exeuctable instructs that instruct the processor 202 to: (i) read (input) the attribute 222, (ii) compute the parameter 224 based on an algorithm or a method that used the attribute 222 as an input (the parameter 224 may also be called a "set-up configuration"), and (iii) write (output) a molding-system set-up parameter 224 (hereafter referred to as the "parameter 224") back to the memory 206. The attribute 222 is associated with the molded part 99. The operator may: (i) view the parameter 224 from the HMI 213, and (ii) manually enter (or automatically transfer) the parameter 224 into the HMI 220 associated with the computer 200; the computer 200 uses the parameter 224 to set up the configuration associate with the system 100 accordingly (and ultimately, to set up the system 100). Alternatively, the computer 201 and the computer 200 may be connected via cabling (not depicted), and the parameter 224 is transferred electronically from the computer 201 to the computer 200. The computers 200, 201 may operate automatically and directly together, or they may operate through manual operator intervention.

For example, a user of a molding system hires a consultant to provide suggestions or recommendations regarding potential set-up configurations parameters for the system 100. The consultant might arrive with the computer 201, which is not owned by the owner of the system 100; the consultant may say use the computer 201 to determine the molding-system set-up parameters for the system 100 given the attributes associated with the molded part that is to be molded by the system 100. Or perhaps the consultation is done over a telephone or over the Internet, etc, and the user of the system 100 receives the molding-system set-up parameters, either verbally, electronically or on paper, etc, and then the user enters the molding-system set-up parameter into the HMI 220 of the computer 200. Alternatively, the computer 200 may be linked electronically to the computer 201, and the configuration set up parameter may be downloaded by using a network, the Internet, etc. The concept depicted in FIG. 1 is that there are two separate computer systems 201 and 202 that are involved, one of which is used to determine the molding-system set-up parameter(s).

The fundamental concept is that a part attribute (that is, the attribute 222 associated with the part or article to be molded) may be inputted to the computer 201 (manually, for example). The computer 201 processes the attribute 222, by using the program 208, and provides or computes the parameter 224, which may then be used to set up the system 100 via the computer 200. The technical effect of the aspects of the present invention is improved set up associated with the system 100 by reducing the trial and error approach (in terms of time) for setting up the system 100 that is associated with known methods. It will be appreciated that without using the computer 200, according to the state of the art, the operator may have to: (i) use a trial and error approach (and potentially waste much time) with determining the molding-system set-up parameter(s) of the system 100, (ii) iteratively make molded parts, and (iii) check the molded parts until such time that the molded part is deemed to be acceptable; the trial and error arrangement of the known method (that is, without the benefit of the aspects of the present invention) may require many days, if not weeks, if not an entire month, to set up the system 100. A technical effect associated with the aspects of the present invention is a reduction of time required to set up the system 100 and to begin molding acceptable parts. So instead of taking weeks, the system 100 may be set up in a relatively shorter time. Another technical effect is that the operator of the system 100 would not have to be highly expert, and the computer 201 is used to generate the molding-system set-up parameter based on the ability of the computer 200 to execute program to compute the set-up parameter. With the assistance of the computer 201, an operator that may have less skill may set up and operate the system 100, respecting the fact that the operator would have to have some level of skill for operating the system 100. The aspects of the invention permit the operator to obtain an estimation of the molding-system set-up parameter, so that the operator may reduce time for: (i) determining the set-up parameters, and (ii) making a molded part that meets requirements in terms of weight, size, solids content and any other desired attribute associated with that molded part.

The computers 200 or 201 may be used to remember the molding-system set-up parameter for future reference so the operator does not need to waste time to set up the system 100 in order to mold a part that was previously molded. For example, there may be two totally different parts to be molded. One part may be a housing for an electronic device (a laptop computer or a cell phone), and the other part may be an automotive part. If both types of parts require the same metallic alloy, the same shot weight, and both parts are to be made on the same system 100, then most of the molding-system set-up parameters may be the same. Preferably, the molded part includes a metallic alloy.

Figure 2:
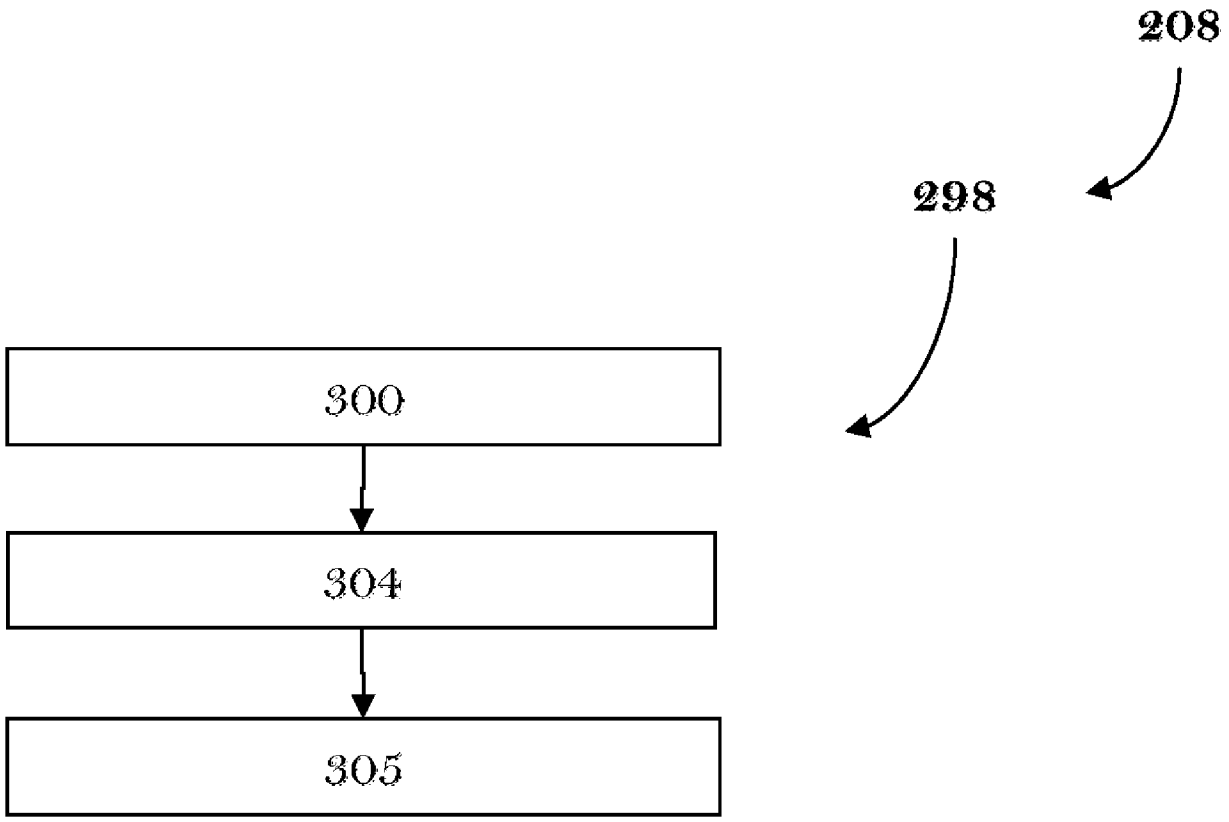
FIG. 2 depicts a schematic representation of the process 298 to be executed by the computer 200 of FIG. 1.

FIG. 2 depicts the schematic representation of the process 298 that may be implemented in the program 208 of FIG. 1. The process 298 includes: (i) a receiving operation 300, (ii) a determining operation 304, and (iii) a providing operation 305. The receiving operation 300 includes receiving an attribute 222 associated with a molded part 99. The determining operation 304 includes determining a parameter 224 based on the attribute 222 associated with the receiving operation 300, in which the parameter 224 is usable for setting up operation associated with the system 100. The providing operation 305 includes providing the parameter 224. A technical effect is that the providing operation 305 reduces time associated with trial and error set up of molding systems. The computer 200 may be configured to execute a program 208 which includes instructions for executing the process 298. The computer 201, according to a non-limiting variant, is not connected to the system 100. The computer 201 inputs data, via a keyboard, etc, computes the molding-system set-up parameter and provides an output indicating the molding-system set-up parameter. Then, the operator manually enters the molding-system set-up parameter into the computer 200 that directly controls the system 100.

Figure 3:
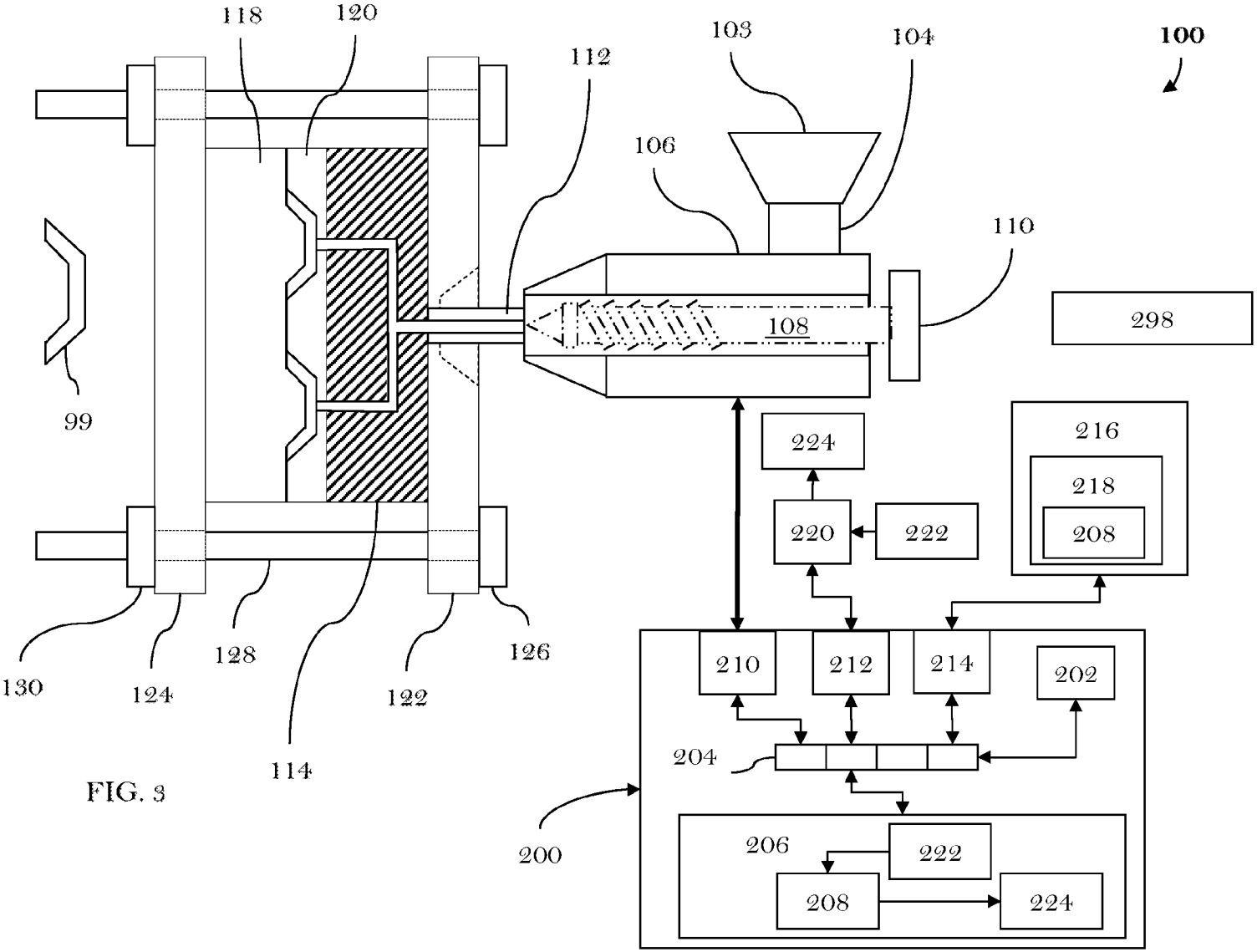
FIG. 3 depicts a schematic representation of the system 100 that is operative in accordance with a process 298 according to a fourth non-limiting embodiment.

FIG. 3 depicts the schematic representation of the system 100 that is operative in accordance with the process 298 according to the fourth non-limiting embodiment. The HMI 220 is connected with the computer 200. The determining operation 304 is performed by the computer 200. The computer 200 controls and monitors the system 100, and in addition also computes the parameter 224. The computer 200: (i) receives the attribute 222 from the operator, through a keyboard, etc, (ii) uses or executes the program 208 to compute or determine the parameter 224, and (iii) outputs that parameter 224 to: (a) the HMI 220 (so that the operator may view the molding-system set-up parameter), and (b) to controllable components associated with the system 100 so that the configuration of the system 100 may be set up accordingly. The operator may then press a button on the HMI 220 that causes the computer 200 to "set up and begin operation." Alternatively, if the operator does not approve of the parameter 224 as computed by the computer 200, the operator may have an opportunity to change the parameter 224 to some degree based on skill and knowledge of the operator.

For operators, usually experience becomes their teacher over time, and some operators have more experience than others. A less experienced operator is more dependent on the computer 200. A more experienced operator may see the benefit of their teaching through some exception which may exist with making certain molded parts, and adjust the parameter 224 accordingly before operating the system 100. The option (of the operator being able to override or make a change to the parameter 224) is provided because their choice may be a better one that may further fine tune the system 100 for set-up purposes. The program 208 may take an operator to a certain distance for setting up the system 100; however if there is some fine tuning that may be required, depending on the article to be molded, the operator may want to adjust the suggested set up parameters that are computer by the computer 200 (that is, in order to achieve a 90 per cent yield, for example). So if the system 100 needs to aim toward further perfection in terms of the parameter 224, the computer 200 may accommodate some manual intervention or fine tuning on behalf of the operator. The parameter 224 that is computed or generated by the computer 200 is not an absolute molding-system set-up parameter for the system 100, but it may represent suggested molding-system set-up parameter. The molding-system set-up parameter generated by the computer 200 is an approximation, which may then may be further optimized or improved. The suggested molding-system set-up parameter as computed by the computer 200 is based on the desired attributes associated with the molded article; the operator of the system 100 may accept the "proposed" parameter 224 or adapt the parameter 224 somewhat based on the knowledge and/or experience of the operator.

After the system 100 is used to make several molded parts, according to the molding-system set-up parameter computed by the computer 200, the molded parts should be tested to determine whether the attributes of the freshly made molded parts match up with the desired attributes 222 to determine whether the molded part is acceptable or not acceptable. If the molded parts are not acceptable, the operator may then manually fine tune or adjust the molding-system set-up parameter so as to make molded arts which may then satisfy the requirements for the attributes. The operator may have to iterate several times, but again the amount of time it would take to get to an acceptable part would be relatively shorter in comparison to what was previously done without using the program 208.

Once the proper molding-system set-up parameter is determined, the operator may save the parameter 224 along with the attributes 222 that were associated with that molding-system set-up parameter. That data may become part of the data that is stored within memory of the computer 200 that could be used again some time in the future so that when parts of a similar requirement are required, perhaps the saved data may be used (at least in part). A better set up might also mean optimization. A typical example of how this sort of situation would occur in a real production environment is as follows: the operator's first goal should be to achieve a sustainable automatic run (production of molded parts) and the benefit here is that this could be done automatically (at least in part) with the computer 200. Once the operator achieves a sustainable automatic run, the operator may decide to not further optimize the set up as computed. The operator may want to make an assessment of the molded part quality and determine if the system 100 has to go through some qualification. When such an item is molded, the mold is made "metal safe". A metal-safe mold is a mold that has features (such as: venting, overflow, etc) that permit removal (or machining) of a very minor amount of material from the molded article once the molded article is removed from the mold. Once the concept for the mold is perfected, the mold may be further machined or adapted so that the molded part may be perfected; that is, less and less material may need to be removed from the molded article; ideally, it is preferred to remove no material from the molded article, but this case is rarely, if ever, achieved.

The definition of "metal safe" may also include the following: the metal safe mold will make a molded article that is incorrectly sized in some way, such that the molded article size can be adjusted by removing a small amount of metal from the mold thereby adjusting the molded article's critical dimension. An example would be making the internal diameter of a molded lid too large initially and reducing its diameter by removing small amounts of metal from the mold portion that is forming the internal diameter. If too much metal is removed the molded lid's internal diameter becomes too small and it will not fit its matching container, trying to recover the mold from this position is expensive.

Part makers often prefer to run the system 100 at an 80 per cent production ability. They do not want to run the system 100 at 100 percent production capability. They usually prefer to operate the system 100 at a very comfortable level, and they want to open up the process generously via the mold. They may go through several mold iterations (that is, continuously adapting the mold); then, at this point, the molding-system set-up parameters that achieve the 80 per cent production ability may produce an acceptable molded part, but may consider further improvements to the set up of the system 100 in order to further optimize the manufacture of the mold part. Optimizing the set up of the system 100 may result in faster cycle times, higher part quality and/or part yield, etc. It is understood that the implementation of the process 298 may be acceptable for a new molding system going forward as depicted in FIG. 3. Whereas in sharp contrast to the system 100 associated with FIG. 1, the process 298 is also acceptable for retrofitting of existing molding systems.

Figure 4B:
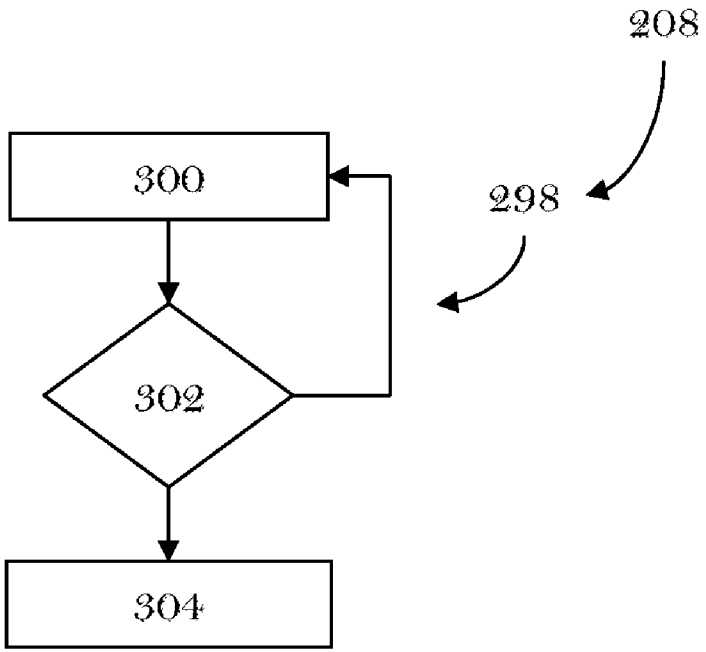
FIGS. 4B, 4C and 4D depict variants of the process 298 of FIG. 3.
Figure 4A:
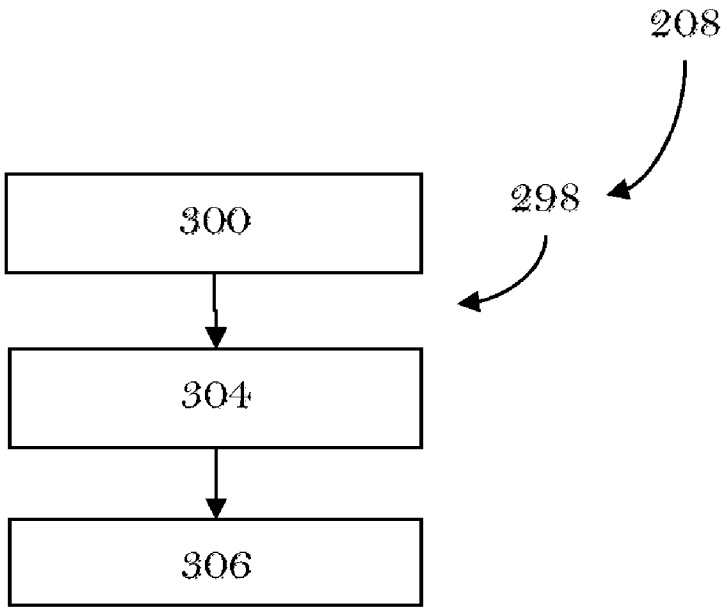
FIG. 4A depicts a schematic representation of the process 298 of FIG. 3.

FIG. 4A depicts the schematic representation of the process 298 of FIG. 3. The process 298 further includes an operating operation 306, including operating the system 100 according to the parameter 224 associated with the determining operation 304.

FIG. 4B depicts a non-limiting variant of the process 298 of FIG. 3, in which the process 298 further includes a determination operation 302, including determining whether to accept the attribute 222 associated with the receiving operation 300. The determination operation 302 is used to check for gross errors.

Figure 4D:
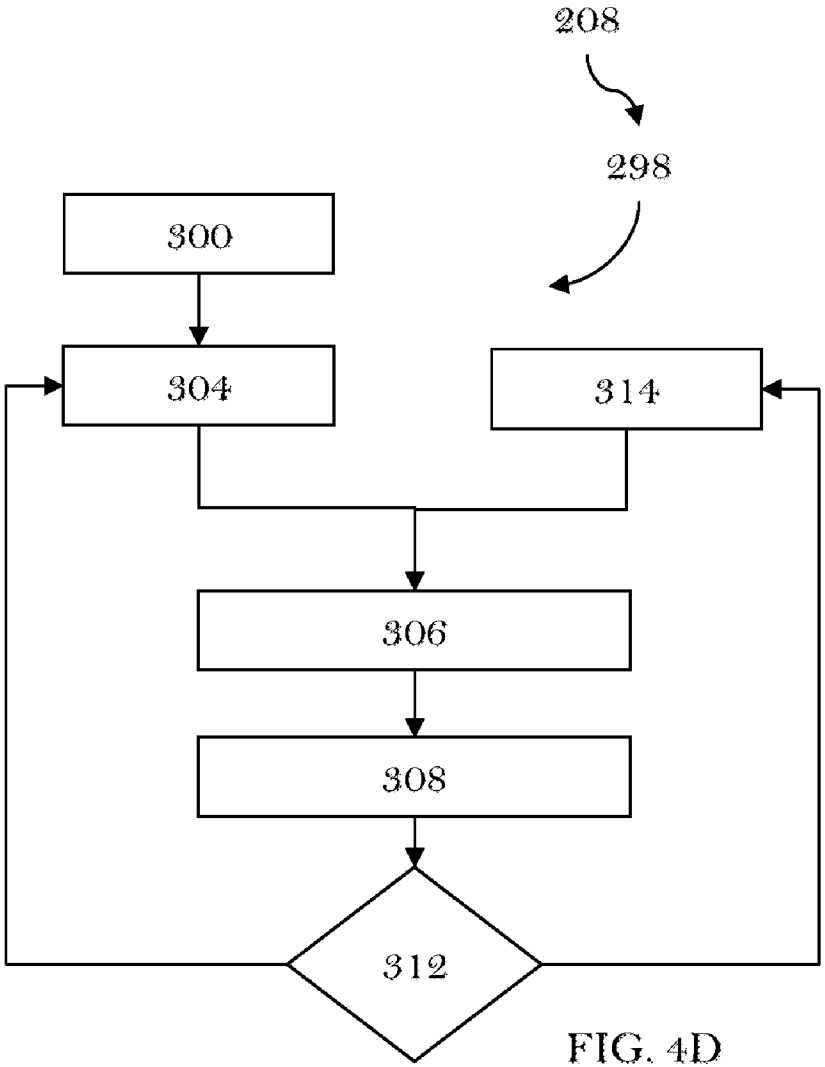
Figure 4C:
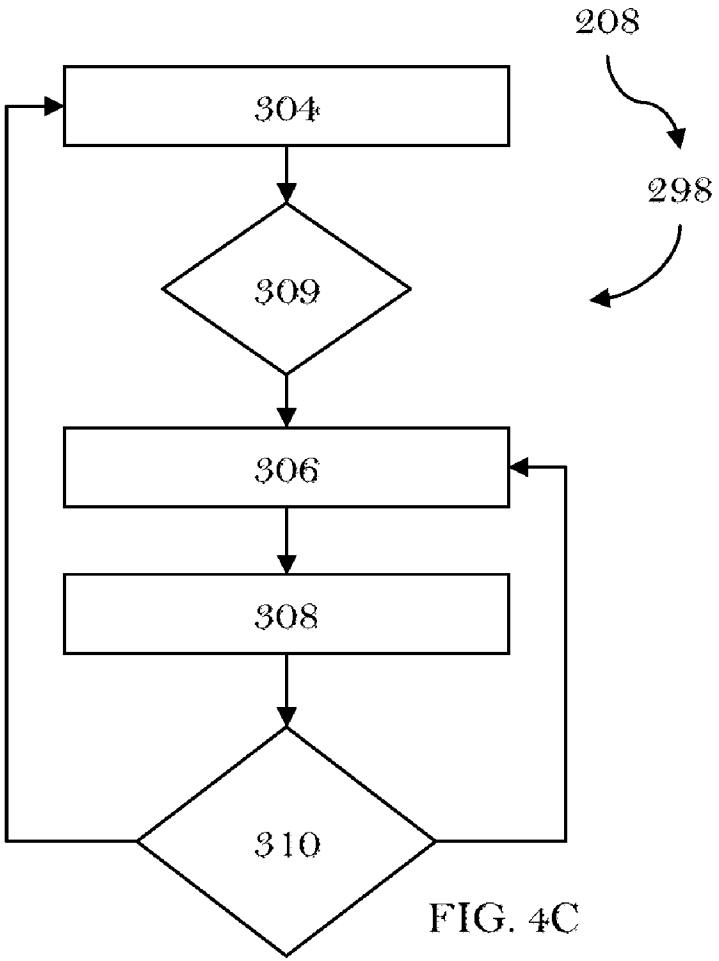

FIG. 4C depicts a non-limiting variant of the process 298 of FIG. 3, in which the process 298 further includes (i) an obtaining operation 308, and (ii) a decision operation 310. The obtaining operation 308 includes obtaining an indication of whether the attribute 222 associated with the receiving operation 300 is acceptable or not acceptable for the system 100. The decision operation 310 includes determining whether any one of: (i) the indication associated with the obtaining operation 308 is acceptable so that the system 100 may continue operating according to the parameter 224 associated with the determining operation 304, and (ii) the indication associated with the obtaining operation 308 is not acceptable so that "another" parameter 224 may be used to operate the system 100.

FIG. 4D depicts a non-limiting variant of the process 298 of FIG. 3, in which the process 298 further includes: (i) a resolving operation 312, and (ii) an over-riding operation 314. The resolving operation 312 includes determining whether an override command for the set up parameter that was received. The over-riding operation 314 includes over-riding the parameter 224 associated with the determining operation 304 with an override (configuration set-up) parameter associated with the resolving operation 312.

Figure 5:
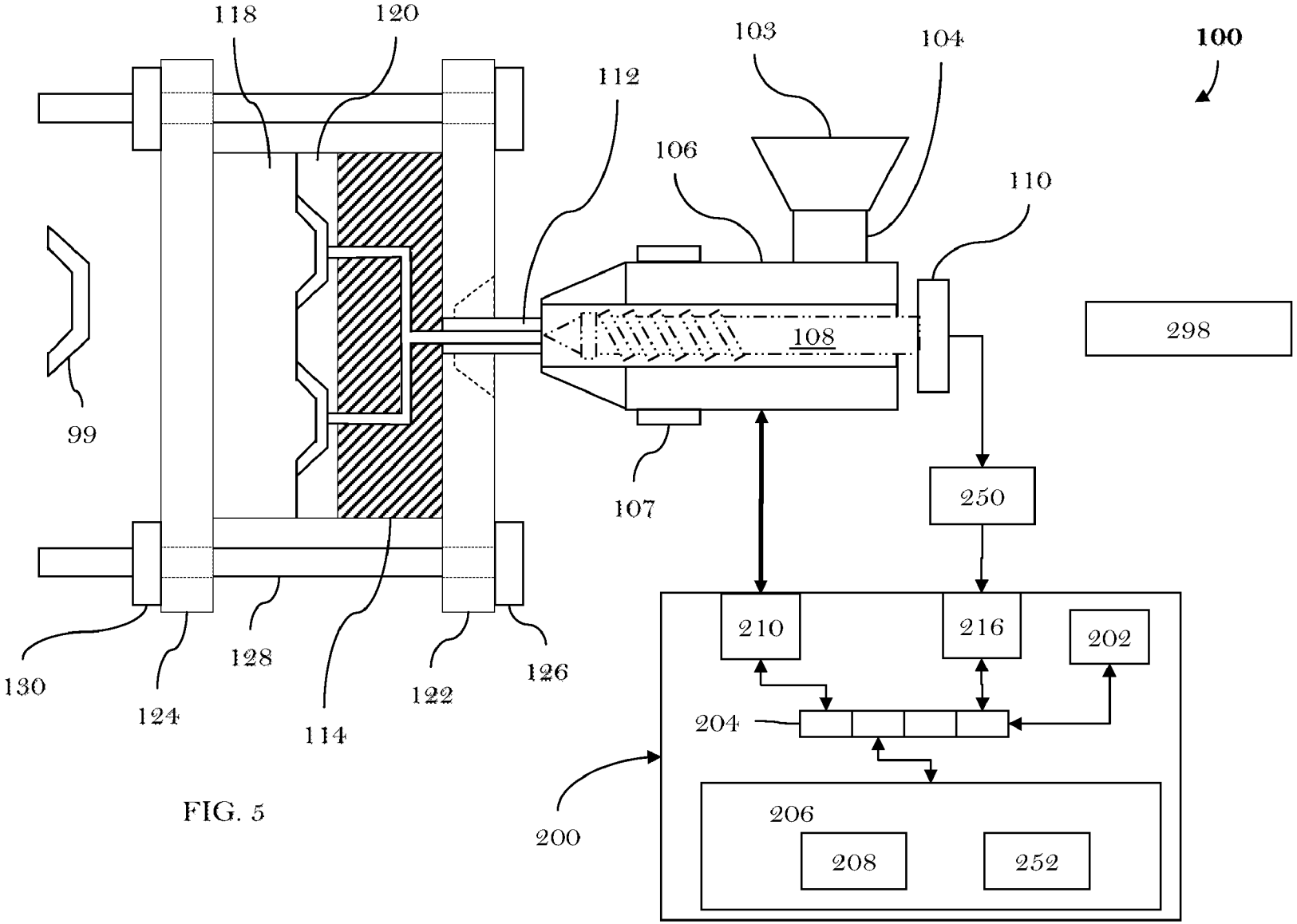
FIG. 5 depicts a schematic representation of the system 100 that is operative in accordance with a variant of the process 298 of FIG. 3.

FIG. 5 depicts the schematic representation of the system 100 that is operative in accordance with a non-limiting variant of the process 298 of FIG. 3. An adaptive-feedback control is based on a sensor 250 and a feedback-control loop 252 associated with the system 100.

Figure 6B:
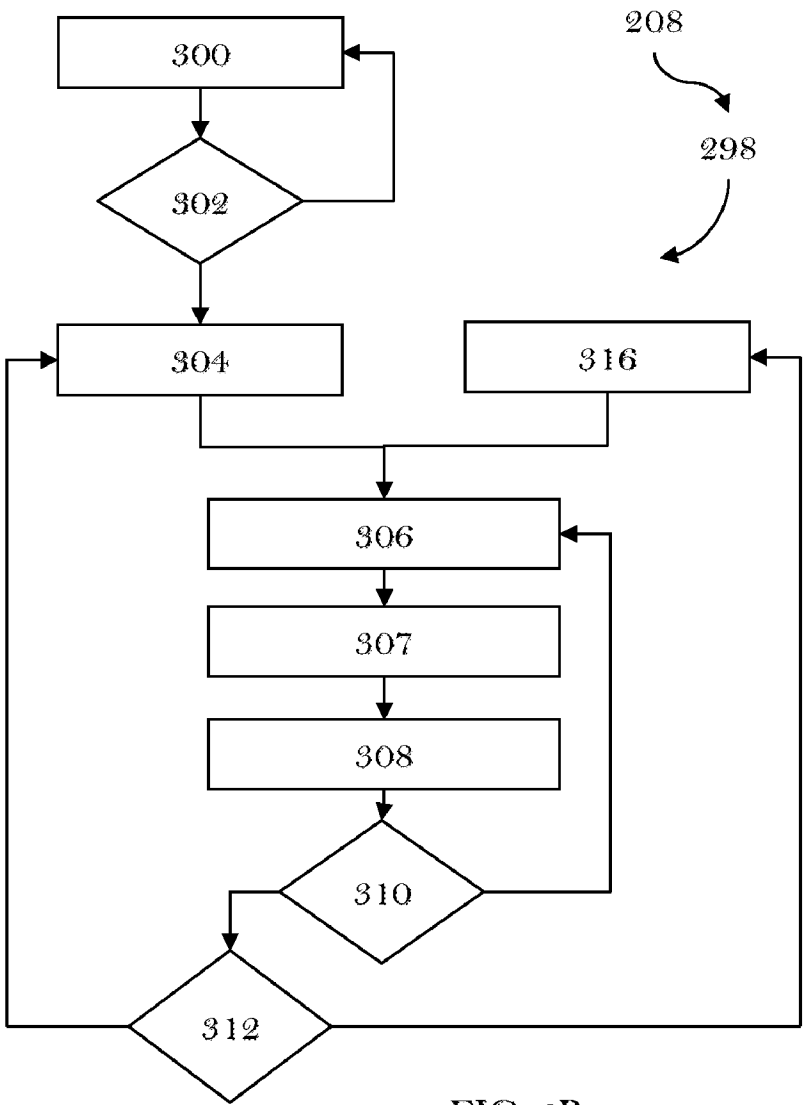
FIGS. 6A and 6B depict variants of the process 298 of FIG. 5.
Figure 6A:
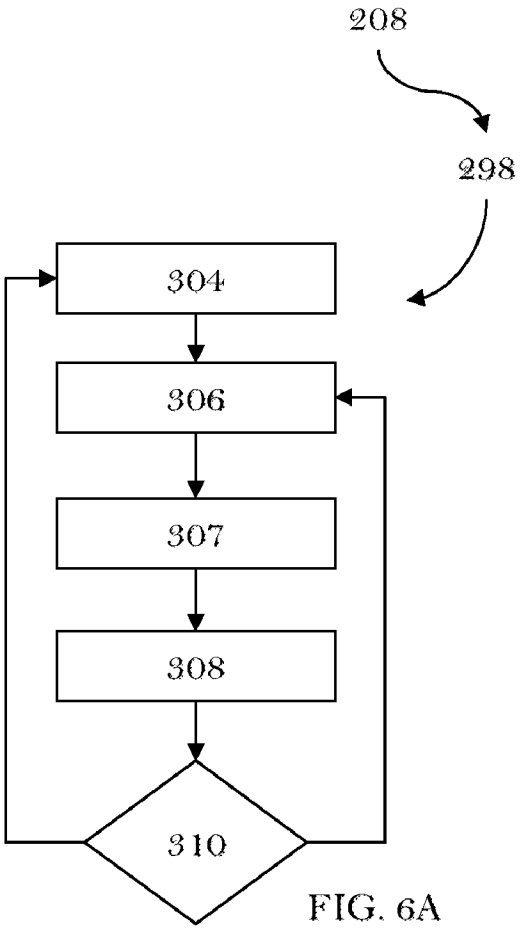

FIG. 6A depicts a non-limiting variant of the process 298 of FIG. 5, in which the process 298 further includes an adjusting operation 307 including adjusting the parameter 224 associated with the determining operation 304 according to an adaptive-feedback control based on a sensor 250 and a feedback-control loop 252 associated with the system 100.

FIG. 6B depicts a non-limiting variant of the process 298 of FIG. 5, in which the process 298 includes operations that were previously described.

Figure 7A:
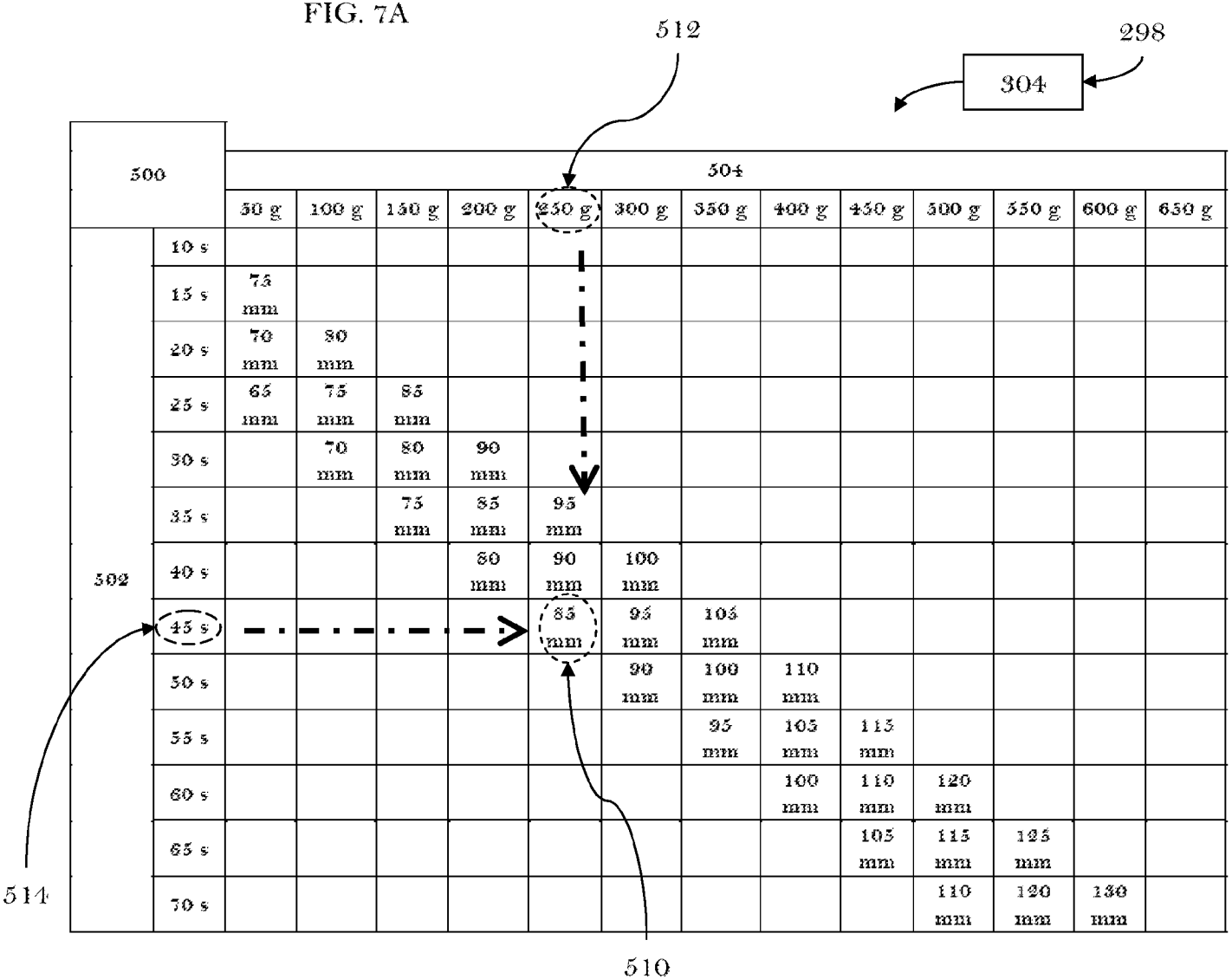
FIG. 7A depicts a determining operation 304 associated with the process 298 of FIG. 1 according to a fifth non-limiting embodiment.

FIG. 7A depicts the determining operation 304 associated with the process 298 of FIG. 1 according to the fifth non-limiting embodiment. The determining operation 304 uses a table 500 (hereafter referred to as the "table 500") for computing the parameter 224 based on the attribute 222. Examples of the attribute 222 are: (i) an alloy used in the molded part 99, (ii) a size of a shot that is to be injected into the mold cavity, and/or (iii) a weight of the molded part 99. The molded part 99 may include other material such as runners, etc, that are part of the molding material injected into the mold cavity (the material injected into the mold is known as the "shot weight"). The program 208 reads the attribute 222 (one or more attributes), and then the determining operation 304 associated with the program 208 computes and outputs the parameter 224.

Along the top moving from left to right of the table 500, there is a column 504 that provides possible shot weights, which is divided into multiple sub-columns each of which is incremented by 50 grams (g), from 50 grams to 650 grams. The selected or desired shot weight 512 for making the molded part 99, for illustrations purposes, is 250 grams (an attribute associated with the molded part 99). There are some economics that may be considered; for example, the molded part 99 may only make money for a company (that is, the business entity that owns and operates the system 100) if the company can make a certain number of shots per hour. This is an industry term called "shots per hour". For the purpose of describing an example, the questions may be asked: (i) "What effort may be needed to make a single shot?, and/or (ii) "How many settings does it take to make a single shot?" Previous testing has provided some data, and in this case for example, by referring down the column there are three numbers placed in the column underneath the 250 gram column, which are: 95 millimeters (mm), 90 mm and 85 mm. These three numbers indicate possible cushion sizes that may be used to make the molded part 99. Another attribute associated with the molded part 99 is a cycle time that is required to make the molded part 99. The rows of the table 500 provide possible cycle times, ranging from 10 seconds (s) to 70 seconds, incrementing by five-second divisions. Generally, the rows of the table 500 are indicated as the row 502 (cycle time). For example, it is desired to permit a 45 second cycle time make a 250 gram shot in association with making the molded part 99. Starting off at the 45 second row and moving across that row toward the 250 gram column, the operator will reach the intersection between the 250 gram column and the 45 second cycle time, and the intersection is populated with a number (that is, 85 millimeters), which is the determined cushion size 510. If there is no number placed in the intersection between a selected column and a selected row of the table 500, then the system 100 cannot be used to make the "proposed" molded part 99. The table 500 is populated with data that has been previously determined by trial and error experimentation with the system 100. If a different molding system were to be used (for example, a molding system that may have a larger barrel, etc), then the table 500 would have to be populated for the larger molding system, etc. So by selecting a desired (selected) shot weight 512, and a desired (selected) molding-system cycle time 514, the determined cushion size 510 may be selected or determined based on using the table 500. The table 500 includes historical data for a particular model number of a molding system, such as the system 100 of FIG. 1. The determined cushion size 510 is an example of the parameter 224 that most operators appear to choose as long as good molded parts are being produced by the molding system.

The determined cushion size 510 may provide some additional benefit. By making the cushion size smaller or larger, it may be possible to influence the solid contents contained within the molded part 99. The solids content refers to the amount of the alloy that did not solidify completely in the barrel assembly of the system 100 before the molten alloy was injected into the mold. Once the molded part 99 is solidified and analyzed, the solids content associated with the molten alloy may be determined (this process is known to persons of skill in the art, and therefore this will not be described here). Sometimes the solids content may be a requirement for making certain molded parts. When the solids content is a required attribute 222 of the molded part 99 that has to be satisfied, multiple versions of the table 500 may be used, in which each version of the table 500 may be used to represent a specific solids range. For example, the table 500 may be used to represent available cushion sizes for: (i) a primary solids range from zero to 5 per cent, (ii) for a specific alloy, such as AZ91D, (iii) that is to be processed for a specific model of a molding system, and (iv) the table 500 was generated from a specific temperature profile associated with the barrel assembly of a particular molding system. These four items (i), (ii), (iii) and (iv) are all fixed. The variables that were introduced are: (i) the shot weight associated with making the molded part 99, and (ii) the cycle time for the economics of making the molded part 99, so that the parameter 224 may include the cushion size, and the system 100 is set up to accommodate that cushion size based on the requirements mentioned earlier.

FIG. 7B depicts the determining operation 304 associated with the process 298 of FIG. 1 according to the sixth non-limiting embodiment. A look-up table 600 (hereafter referred to as the "table 600") is depicted, in which the table 600 is populated with temperature set points (also known as temperature profile presets) indicated in Fahrenheit (F). A column 602 is used to indicate general presets P1, P2, P3, P4 and P5. Columns 604, 606, 608 are used to represent Zones A, B and C respectively of the barrel assembly 106. Some zones are not included in the barrel assembly 106, and these zones may be associated with a hot runner system. For example, (i) zone A1 represents a tip of a hot sprue, (ii) zone A2 represents a maintenance zone of the hot sprue, (iii) zone A3 represents a flange zone, (iv) zone A4 represents a cooling ring, (v) zone A5 represents a nozzle extension, (vi) zone A6 represents a nozzle adapter number 1, (vii) zone A7 represents a nozzle adapter number 2, (viii) zone A8 represents a barrel head, (ix) zone A9 represents a high pressure zone number 1, (x) zone B1 represents a high pressure zone number 2, (xi) zone B2 represents a barrel flange, (xii) zone B3 represents a low pressure zone number 1, (xiii) zone B4 represents a low pressure zone number 2, (xiv) zone C1 represents a low pressure zone number 3, (xv) zone C2 represents a low pressure zone number 4, and (xvi) zone C3 represents a low pressure zone number 5. The table 500 of FIG. 7A is matched up with a specific (preset) temperature profile for the barrel assembly 106, such as being matched up with the P3 temperature profile preset. The presets associated with P1, P2, P4 and P5 are not indicated in the table 600. These presets may be filled in for the case when fine tuning of the temperature profile for the barrel assembly 106 is required. The temperature profile of the barrel assembly 106 may be determined in advance. For example, fine tuning of the temperature profile may be required if the solids content of the molded part 99 needs to be adjusted or corrected. The table 500 of FIG. 7A may be set up for achieving a solids content in the range from 0 to 5 per cent. The operator may wish to achieve the middle of the range at 2.5 or 3 per cent solids content. Then fine tuning of the temperature presets may be used to achieve the desired result by selecting presets associated with P2, and P2 gives an acceptable temperature profile that yields two per cent solids content. Once the presets associated with P2 are determined, (perhaps on a trial and error basis), then P2 becomes available for future use. It will be appreciated that for every temperature profile P1 to P5, there is a corresponding respective table 500.

As depicted in FIG. 7B, table 600 is empty for P1, P2, P4 and P5, that may suggest that look-up tables 500 for those presets at this time are not available. However, the table 600 may be populated and additional look-up tables 500 may be generated in association with each one of these presets from P1 to P5. The purpose of the table 600 is that the operator is using a preset temperature profile that meets the requirements for the alloy being processed by the barrel assembly 106. For example, the table 500 and the table 600 may be generated by the manufacturer of the molding system in a controlled environment. Also, the table 500 may be generated by the owner of the molding system who decides to do their own testing and collect their own historical information and populate the table 500 and the table 600. Populating the table 500 and the table 600 is a trial and error process, but once the data is gathered and is placed into the table 500 and the table 600, this helps to determine the parameter 224 for future articles that have to be manufactured (molded).

Figure 7C:
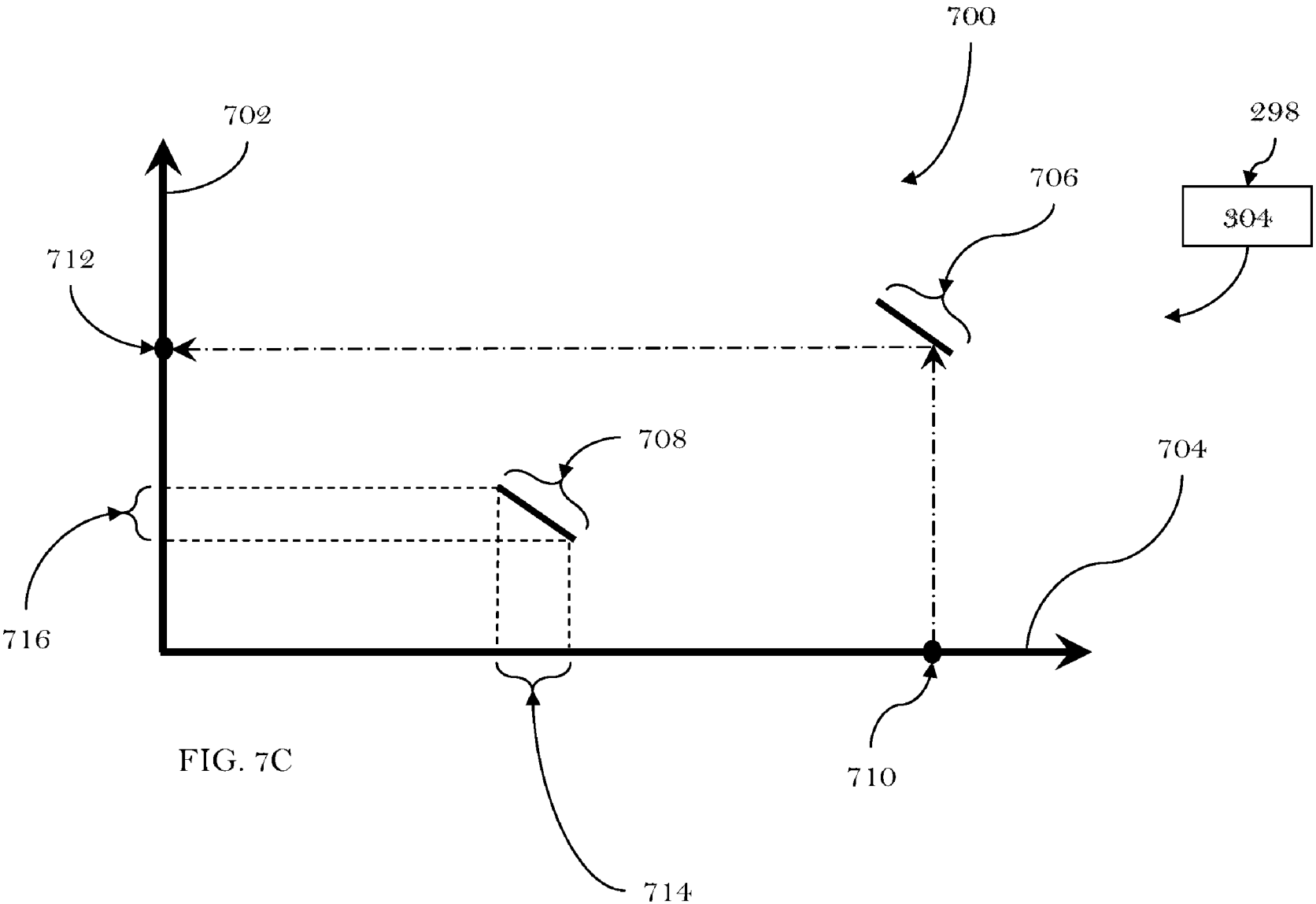
FIG. 7C depicts a determining operation 304 associated with the process 298 of FIG. 1 according to a seventh non-limiting embodiment.

FIG. 7C depicts the determining operation 304 associated with the process 298 of FIG. 1 according to the seventh non-limiting embodiment. A graph 700 may be used to determine the parameter 224. A vertical axis 702 represents a cushion size used in the barrel assembly 106 of the system 100. The cushion size may be defined as the material (the melt) that remains in front of the screw 108 after the mold cavity is completely filled with melt that solidifies to form the molded part 99. The molded part 99 is made because the screw 108 has pushed the melt from the barrel assembly 106 into the mold cavity. But the barrel assembly 106 is never emptied of its entire contents as may occur in cold-chamber die casting. In the barrel assembly 106, there is some material left in front of the screw 108. A horizontal axis 704 represents cycle time of the system 100. There is a relationship that exists between a shot weight, a cycle time and a cushion size. The graph 700 shows this relationship in a different way. For instance, if a 100-gram shot is to be made, then curve 706 is used, and if the required cycle time 710 is also given (and plotted in the horizontal axis 704), it may be possible to interpolate upwards from the required cycle time 710 to the curve 706, intersect with the curve 706 and then move horizontally across toward the vertical axis 702, and determine a setting 712 for the cushion size.

A curve 708 may be used for a required shot weight of 50 grams, and the curve 706 may be used for a 100 gram shot weight. This arrangement suggests that there is a range that is available that may be used for a given molding system. The graph 700 is set for: (i) a certain solids content (also called a primary solids range, for example from 0 to 5 per cent), (ii) an alloy type, for example AZ91D, (iii) a specific model of a molding system, and (iv) a preset temperature profile of the barrel assembly 106. This arrangement may make it possible for the manufacturer of molded parts to determine the feasibility of making a proposed molded part without having to go through a trial and error approach. They may determine up front (that is, without having to actually make the molded part) whether the molding system could handle such a shot weight under given circumstances. The manufacturer who wants to make a part, using a 100-gram shot that needs to be placed in a mold cavity (for example), may determine the cycle time that the molding system may achieve. Then the manufacturer may determine whether, based on the cycle time being too low or too high (etc), the molding system is capable of making the proposed molded part. Perhaps another graph (similar to the graph 700) that is associated with another model or type of molding system may have the proper characteristics or abilities that satisfy the cycle time that is desired by the maker of the part. The graph 700 may indicate if the molding system can handle the proposed article to be molded.

Figure 7D:
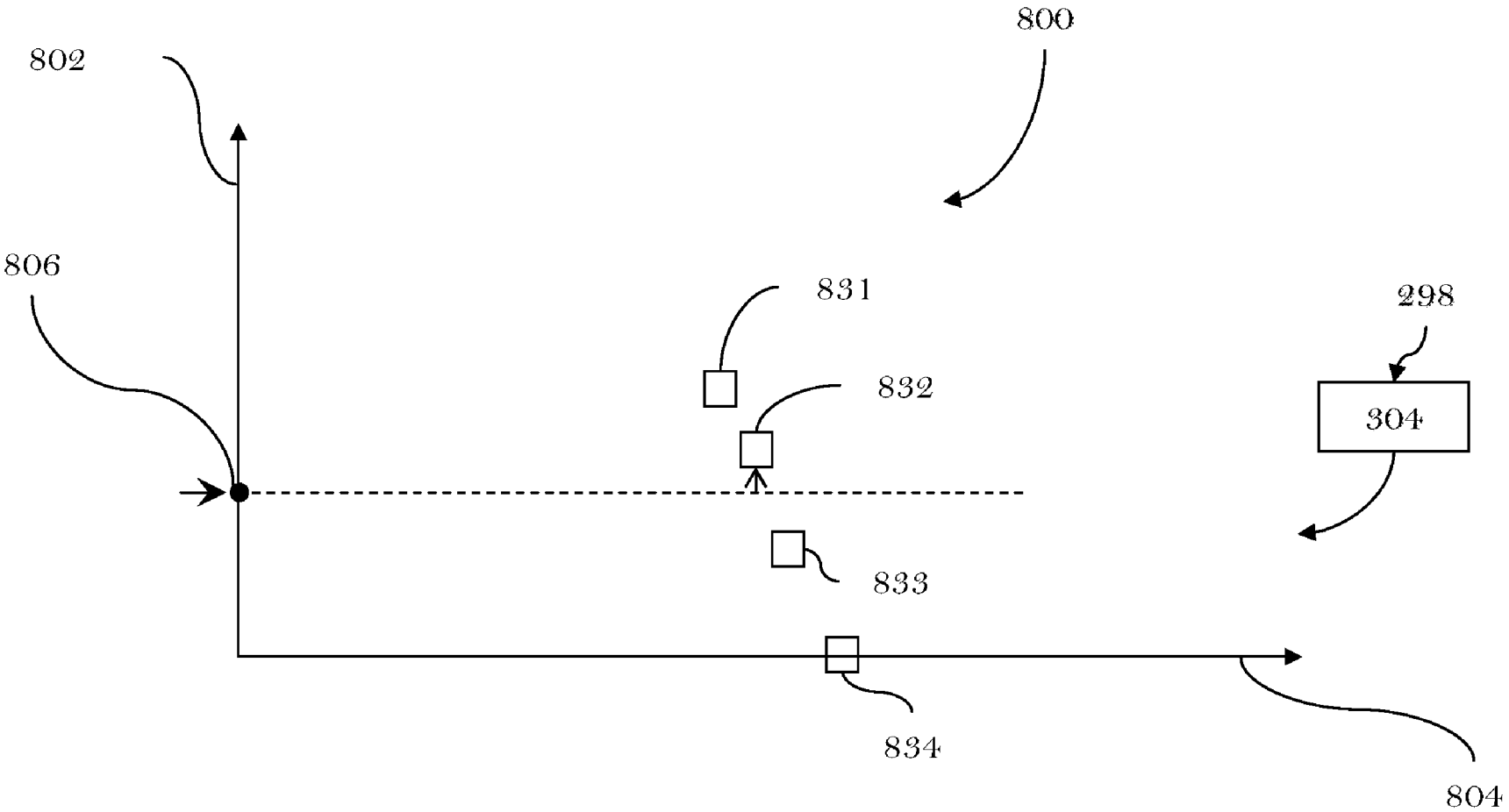
FIG. 7D depicts a determining operation 304 associated with the process 298 of FIG. 1 according to an eighth non-limiting embodiment.

FIG. 7D depicts the determining operation 304 associated with the process 298 of FIG. 1 according to the eighth non-limiting embodiment. A graph 800 includes: (i) a vertical axis 802 that represents a solids content of the molded part 99, and (ii) a horizontal axis 804 that represents a residency time. Residency time, in units of seconds, may be defined as an alloy volume multiplied by the system cycle time, divided by a shot volume. One way to conceive this concept is to think of a pie, and to ask how many slices of pie reside under the influence of heat within the molding system before they become pushed out from the barrel and injected into the mold cavity. Each one of the slices of pie may be the full injection for the shot volume, which could be looked at also as the shot weight. The longer that piece of pie stays in the barrel assembly 106, then the residency time has increased. With more residence time, more heat may influence the shot portion, and that will further melt the melted alloy (residing in the barrel assembly 106) so as to reducing the solids content contained in the melted alloy. The residency time is the average amount of time that the alloy is exposed to the heat of the barrel assembly 106, from being fed into the feed throat to being injected into the mold cavity. Residence Time [seconds]=Alloy Volume [cubic centimeters]×Cycle time [seconds]/Shot Volume [cubic centimeters].

Cubes 831, 832, 833 and 834 represent a cushion value (that is, the cubes 831-834 represent an indication of cushion values). If the cushion value becomes bigger, that means that the screw 108 will reside further back from the machine nozzle 112. This arrangement will increase the volume of melted alloy that resides in the barrel assembly 106, and as a result there will be more shot portions that are under the influence of heat. If this is the case, a lower solids content is expected. The program 208 reads the attributes (required solids content, the alloy type, the model of the molding system, the shot weight). The program 208 uses empirical data that has been provided to create a data bank of information, and then determines an appropriate cushion size may be determined that best meets the attributes. The graph 800 provides a way of showing how, with the cushion size increasing, the residency time also increases.

The parameter 224 may be determined by selecting the desired solids content at point 806, drawing a horizontal line across the graph 800, and then determining the nearest cushion set up to the drawn line. The graph 800 is associated with a specific alloy type, the model of the molding system, and the shot weight, and the temperature profile. So the input here would be to identify the solids content that is required, and then interpolate over to determine what cushion value was set at the time to create that solids content. It may be that the best point or the closest pointed is selected.

Figure 7E:
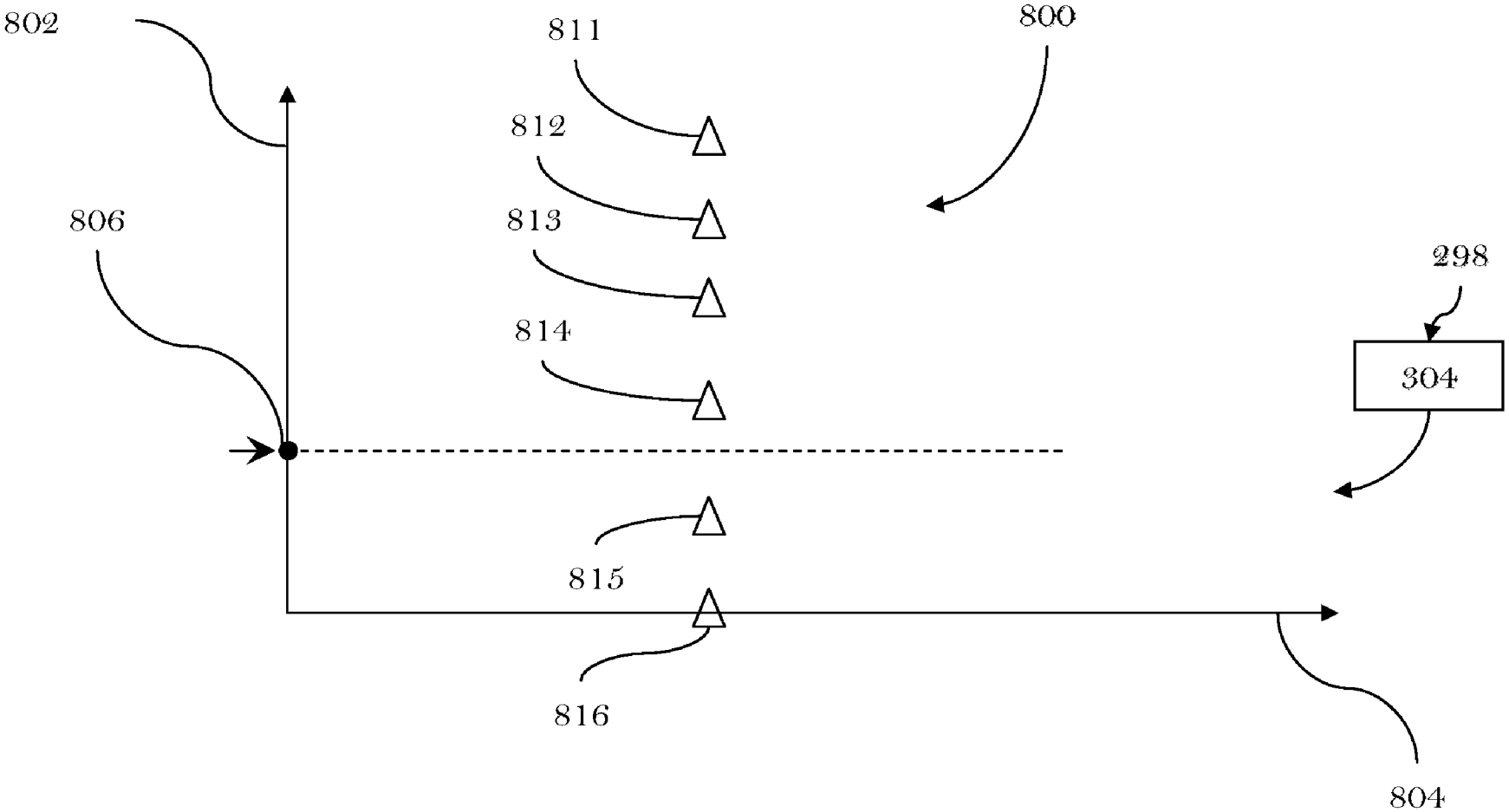
FIG. 7E depicts a determining operation 304 associated with the process 298 of FIG. 1 according to a ninth non-limiting embodiment.

FIG. 7E depicts the determining operation 304 associated with the process 298 of FIG. 1 according to the ninth non-limiting embodiment. The graph 800 has the same axes as indicated in FIG. 7D, but now includes an indication of temperature presets, indicated as triangles (or points) 811, 812, 813, 814, 815 and 816 based on a temperature presets. Preset P3 (see table 600 of FIG. 7B) is associated with the temperature profiles 814. When temperature presets P1, P2, P4 or P5 become available, other triangles (that is, points) such as temperature profiles indicated by triangles 813, 812, 811, 815 or 816 (respectively) may be added to the graph 800. By changing the temperature presets, the residency time 804 is not affected. The residency time is measured in seconds. By changing temperature, the residency time is not changed, but the solids content may be changed as a result of changing temperature of the barrel assembly 106. The graph 800 depicted in FIG. 7E shows that for a certain temperature profile, certain solids content may be obtained. But when this information was recorded, the molding system was operating at a certain residency time. So this point does not only suggest that this one parameter alone can create that condition, but also the parameters aside from the temperature profile can create that condition: for example: (i) the cushion size during this data collection, and/or (ii) the cycle time set during the data collection. The graph 800 of FIG. 7E illustrates how temperature changes on their own do not affect the residency time. By selecting the solids contents (such as the point 806), then the temperature profile set up may be determined that may best chosen for the desired solids content.

Figure 7F:
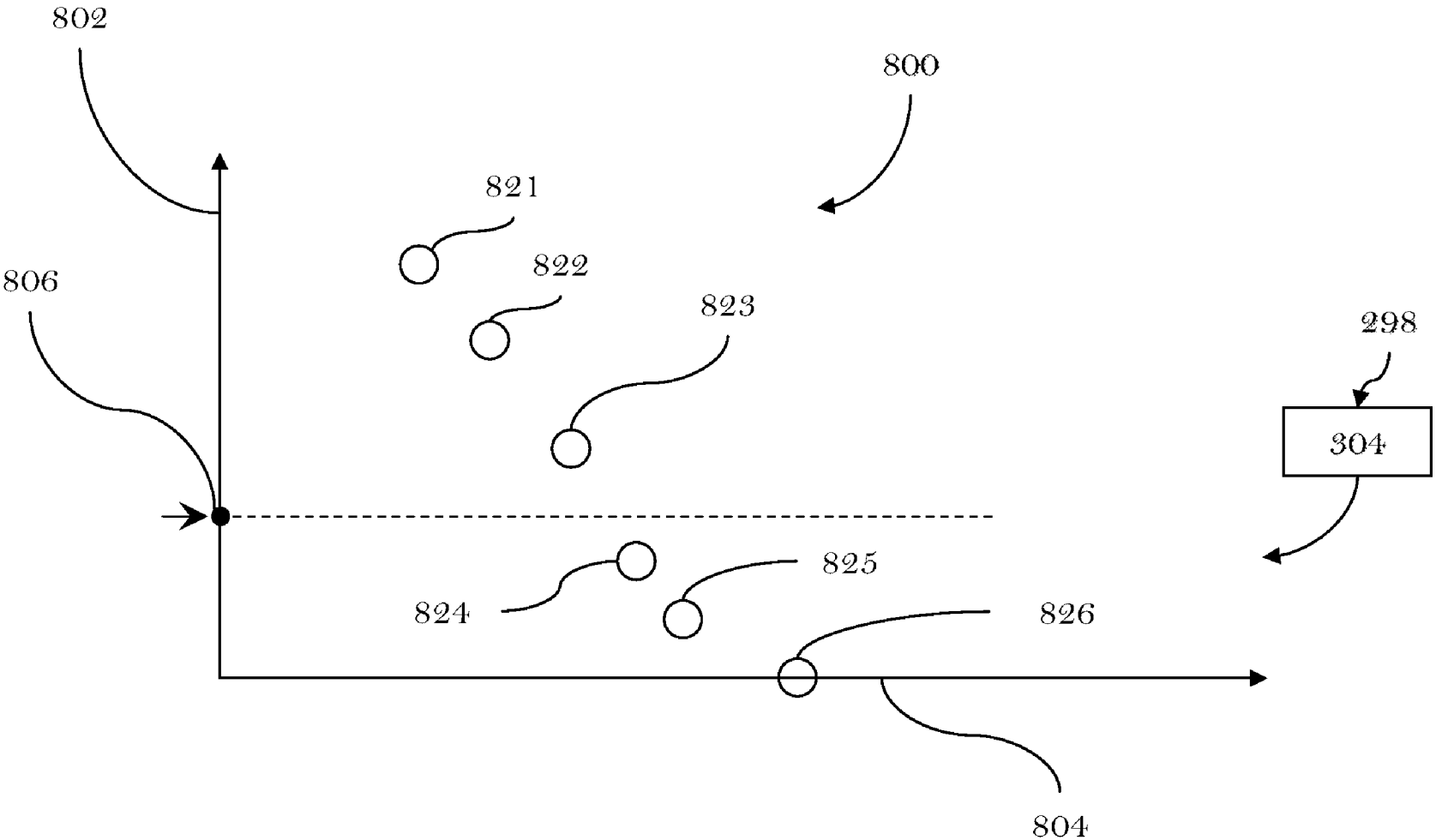
FIG. 7F depicts a determining operation 304 associated with the process 298 of FIG. 1 according to a tenth non-limiting embodiment.

FIG. 7F depicts the determining operation 304 associated with the process 298 of FIG. 1 according to the tenth non-limiting embodiment. The graph 800 includes a plotting of circles 821, 822, 823, 824, 825 and 826 that indicate cycle times. A factor that may have to met may be cycle time, and sometimes this attribute may be an overriding factor than the solids content (or other attributes). So for this purpose here, as depicted in the graph 800 of FIG. 7F, a cycle time may be selected (such as the point for cycle time associated with the circle 824), and then by moving across and to the vertical axis 802, the solids content may be determined (for a given molding system, using a given alloy for a given shot weight on a certain temperature profile).

Figure 7G:
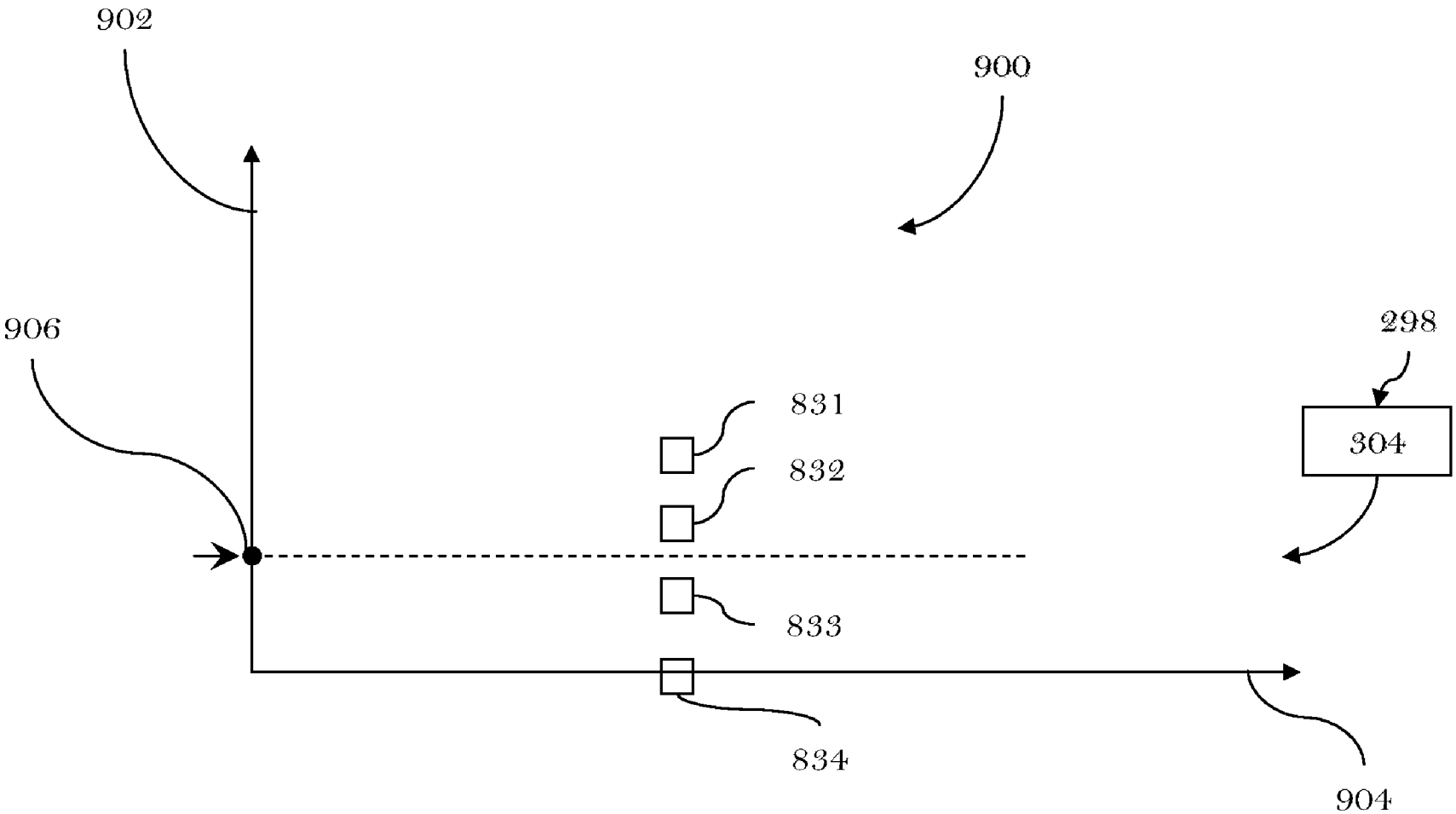
FIG. 7G depicts a determining operation 304 associated with the process 298 of FIG. 1 according to an eleventh non-limiting embodiment.

FIG. 7G depicts the determining operation 304 associated with the process 298 of FIG. 1 according to the eleventh non-limiting embodiment. A graph 900 includes a vertical axis 902 that represents solids content, and a horizontal axis 904 that represents throughput. Throughput (kilograms per hour) is computed by multiplying the average shot weight by the number of cycles per hour, and this represents how much material is being pushed out of the barrel assembly 106 in a given time. The graph 900 shows that when the cushion value is changed and only the cushion value is changed, the solids content may be affected. So if it is determined that a certain molding system may handle a certain throughput, that may be preserved but still influence the solids content by influencing changes to the cushion size, this is another way of showing the possibility of still having the determining operation 304 operate and preserve other important parameters that may need to be locked or preserved. The cushion change does not impact throughput for a given process, but there is some control for the solids content. So by selecting desired solids content, the desired or the closest cushion value may be obtained that meets a certain throughput. The information plotted on the graph 900 is plotted in a vertical line. But that line is all under one value of throughput. So for the molding system, it will be known that (for a given alloy, on a given molding system, a given shot size) that a certain solids content is required, and that the operator does not want to sacrifice throughput, or determine that the cycle time is a certain value of cushion that has to be set. If the throughput could be changed, then this chart is may not be applicable, and so a new chart would have to be used. So a new vertical line may be needed to represent the new cushion values for that throughput. The cubes 831, 832, 833 and 834 may be treated as the only thing that separates their position from the cushion value. To have the entire pattern shift from one side of the graph to the other, it may be required to change some parameters (it could be just cycle time, for example). Something about the molding system has changed, and that changes the throughput of the system 100. Anything that make the cycle time longer or shorter would shift the points that form a curve shown in the graph. And then the new curve would then have to be identified for that new condition. So again, this is a trial and error situation that requires the collection of data.

Figure 7H:
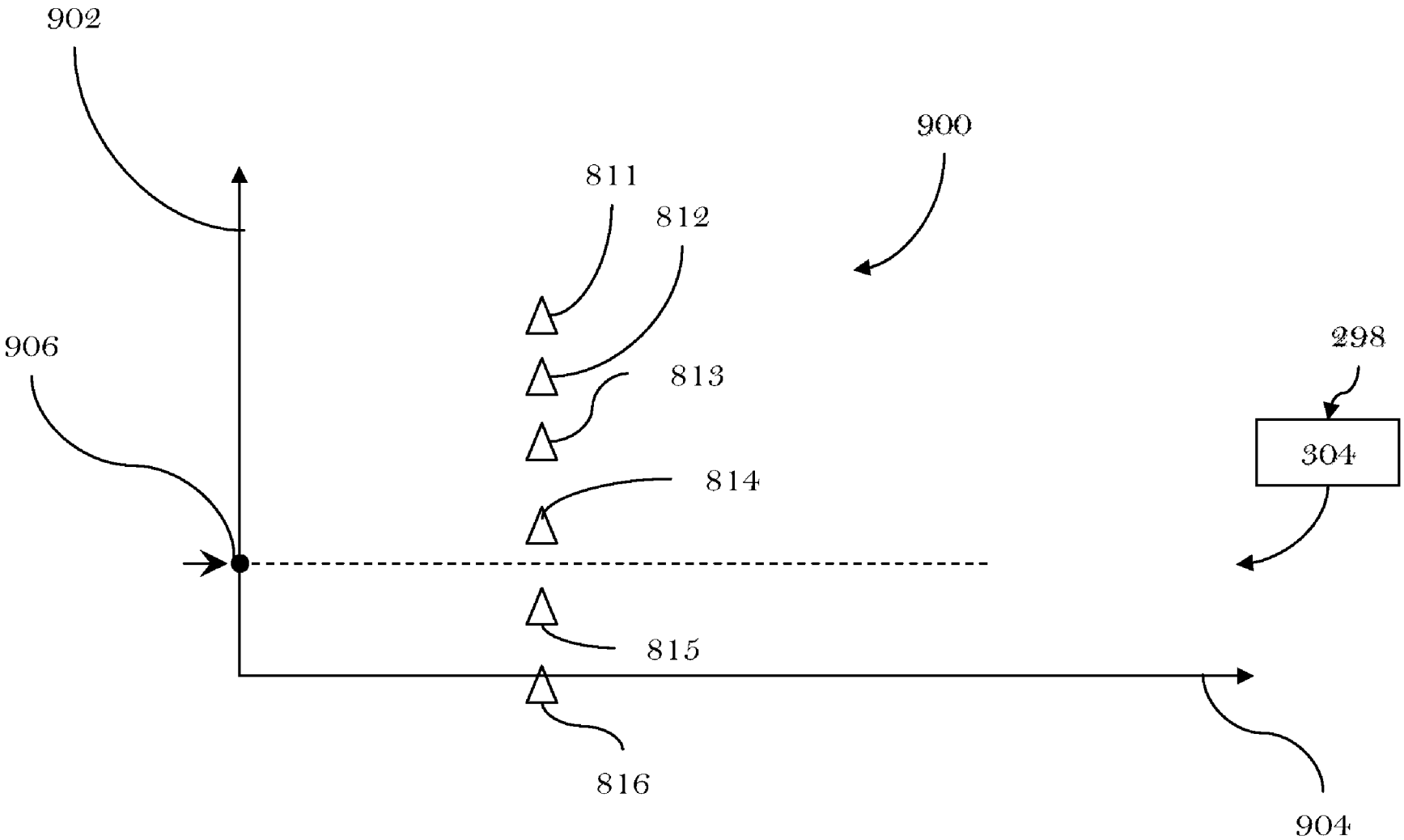
FIG. 7H depicts a determining operation 304 associated with the process 298 of FIG. 1 according to a twelfth non-limiting embodiment.
Figure 7I:
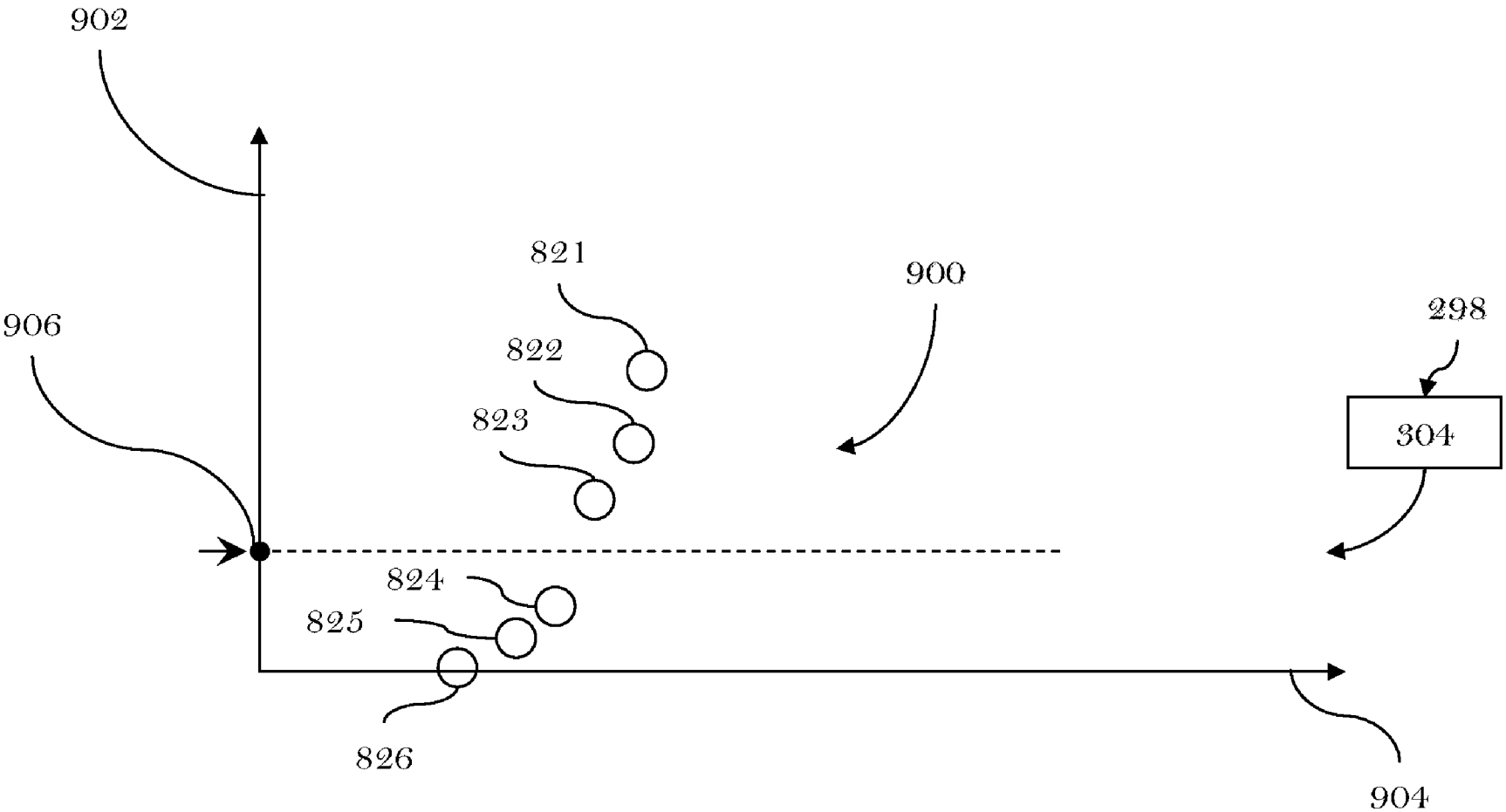
FIG. 7I depicts a determining operation 304 associated with the process 298 of FIG. 1 according to a thirteenth non-limiting embodiment.

FIG. 7H depicts the determining operation 304 associated with the process 298 of FIG. 1 according to the twelfth non-limiting embodiment. An indication of temperature profiles is associated with triangles 811, 812, 813, 814, 815 and 816 that are plotted on the graph 900 that shows solids content versus throughput. The temperature profile does not impact throughput, but the temperature profile does have some control for increasing or lowering the solids content. So once again, throughput for a given process could be preserved or maintained and temperature could be adjusted to fine tune solids content. The general relationship is that there is some level of control through temperature changes where throughput could not be affected. For example, if a molding system is running with a 20-second cycle time and there is a 5 per cent solids content that is desired, but the measured solids content is higher than 5 per cent, then more heating capability is required but there is a need to preserve cycle time. Since it is not possible to run the molding system longer to have more influence of heat, (or to increase the cushion size), then the option is to increase heat to have more melting capability. So triangle 815 would be an example of a higher melting capability than triangle 814. And moving across to the left, it can be seen that the solids content moves closer to zero. There is an opportunity to look for the solids content that may be required at a given point in the configuration set up. For example, a point in the set up where most of the items have been locked in that are not to be changed (such as cycle time). But there may still be a requirement to be able to change solids content. There is an opportunity to change temperature to have some control.

FIG. 71 depicts the determining operation 304 associated with the process 298 of FIG. 1 according to the thirteenth non-limiting embodiment. In graph 900, there is no straight line; but there is a curve line, which means there is a parameter being changed that does influence throughput, and that parameter is cycle time (that is, an indication of cycle time). There are many things that can change cycle time. As the throughput decreases, more influence of heat and the solids content will decrease. But after throughput is increased, the molded parts may be made faster. For example, if the original cycle time is 20 seconds, and now there is a cycle time of 10 seconds, there is more demand being placed on the molding system. The throughput increases (that is, more melted alloy is being pushed out from the barrel assembly 106 in a given time). This would remove the influence of heat and increase the solids content. If for some reason, it is not permitted to change temperature, it may be possible to that the molding system has reached its performance capabilities. But there may be a desired to be in a position where there may be some control of the solids content. It may be possible to run with a longer cycle time, if the first priority is to target the solids content and second priority would be cycle time (such as 20 seconds). It may be possible that the parts quality and solids content far exceeds priority over the time it takes to make a molded part (this may represent a low volume run). So once again, this is just another attribute that can be presented to the program 208 in a different manner where certain parameters become fixed now and other parameters are permissible to change.

The description of the non-limiting embodiments provides non-limiting examples of the present invention; these non-limiting examples do not limit the scope of the claims of the present invention. The non-limiting embodiments described are within the scope of the claims of the present invention. The non-limiting embodiments described above may be: (i) adapted, modified and/or enhanced, as may be expected by persons skilled in the art, for specific conditions and/or functions, without departing from the scope of the claims herein, and/or (ii) further extended to a variety of other applications without departing from the scope of the claims herein. It is to be understood that the non-limiting embodiments illustrate the aspects of the present invention. Reference herein to details and description of the non-limiting embodiments is not intended to limit the scope of the claims of the present invention. Other non-limiting embodiments, which may not have been described above, may be within the scope of the appended claims. It is understood that: (i) the scope of the present invention is limited by the claims, (ii) the claims themselves recite those features regarded as essential to the present invention, and (ii) preferable embodiments of the present invention are the subject of dependent claims. Therefore, what is to be protected by way of letters patent are limited only by the scope of the following claims:

What is claimed is:

1. A molding-system set-up process, comprising:

a receiving operation, including receiving an attribute associated with a molded part;

a determining operation, including determining a molding-system set-up parameter based on the attribute associated with the receiving operation, the molding-system set-up parameter being usable for setting up a molding-system operation; and a providing operation, including providing the molding-system set-up parameter, wherein:

the determining operation further includes:

using a graph, the graph including:

a vertical axis representing a solids content of the molded part, a horizontal axis representing a residency time, and an indication of cushion values; and determining the molding-system set-up parameter by selecting a desired solids content, and drawing a horizontal line across the graph and find a cushion set up based on the indication of cushion values, the graph being associated with a specific alloy type, a model of a molding system, and a shot weight, and a temperature profile.

2. A molding-system set-up process, comprising:

a receiving operation, including receiving an attribute associated with a molded part;

a determining operation, including determining a molding-system set-up parameter based on the attribute associated with the receiving operation, the molding-system set-up parameter being usable for setting up a molding-system operation; and a providing operation, including providing the molding-system set-up parameter, wherein:

the determining operation further includes:

using a graph, the graph including:

a vertical axis representing a solids content of the molded part, a horizontal axis representing a residency time, and an indication of temperature presets; and determining the molding-system set-up parameter by selecting a desired solids content, and drawing a horizontal line across the graph and find a cushion set up based on the indication of temperature presets, the graph being associated with a specific alloy type, a model of a molding system, and a shot weight, and a temperature profile.

3. A molding-system set-up process, comprising:

a receiving operation, including receiving an attribute associated with a molded part;

a determining operation, including determining a molding-system set-up parameter based on the attribute associated with the receiving operation, the molding-system set-up parameter being usable for setting up a molding-system operation; and a providing operation, including providing the molding-system set-up parameter, wherein:

the determining operation further includes:

using a graph, the graph including:

a vertical axis representing a solids content of the molded part, a horizontal axis representing a residency time, and an indication of cycle time; and determining the molding-system set-up parameter by selecting a desired solids content, and drawing a horizontal line across the graph and find a cushion set up based on the indication of cycle time, the graph being associated with a specific alloy type, a model of a molding system, and a shot weight, and a temperature profile.

4. An injection-molding system configured to operate according with the molding-system set-up process of any one of claim 1, claim 2 and claim 3.

5. An article of manufacture including a computer-usable medium embodying instructions usable for instructing a computer to control a molding system in accordance with the molding-system set-up process of any one of claim 1, claim 2 and claim 3.

* * * * *